US010725401B2

(12) United States Patent
Ogasawara et al.

(10) Patent No.: US 10,725,401 B2
(45) Date of Patent: Jul. 28, 2020

(54) DEVELOPING DEVICE WITH A GAP FORMING MEMBER AND IMAGE FORMING APPARATUS HAVING THE SAME

(71) Applicants: KABUSHIKI KAISHA TOSHIBA, Tokyo (JP); TOSHIBA TEC KABUSHIKI KAISHA, Tokyo (JP)

(72) Inventors: Masato Ogasawara, Tokyo (JP); Masayuki Kasukawa, Misato Saitama (JP); Koji Imamiya, Kawasaki Kanagawa (JP); Sunao Takenaka, Odawara Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 197 days.

(21) Appl. No.: 15/941,204

(22) Filed: Mar. 30, 2018

(65) Prior Publication Data

US 2019/0018346 A1 Jan. 17, 2019

(30) Foreign Application Priority Data

Jul. 14, 2017 (JP) ..... 2017-138218

(51) Int. Cl.
*G03G 15/08* (2006.01)

(52) U.S. Cl.
CPC . *G03G 15/0898* (2013.01); *G03G 2215/0872* (2013.01)

(58) Field of Classification Search
CPC ..... G03G 15/0898; G03G 2215/0872
See application file for complete search history.

(56) References Cited

U.S. PATENT DOCUMENTS 4,453,493 A * 6/1984 Sawayama ..... G03G 15/09 118/602
5,517,286 A * 5/1996 Tada ..... G03G 15/09 399/262
2013/0164045 A1* 6/2013 Onoda ..... G03G 15/081 399/274

(Continued)

FOREIGN PATENT DOCUMENTS

JP 08305160 A * 11/1996
JP 11161008 A * 6/1999

(Continued)

*Primary Examiner* — Susan S Lee
(74) *Attorney, Agent, or Firm* — Kim & Stewart LLP

(57) ABSTRACT

A developing device includes a housing having an opening in a wall, a developing roller having a hollow interior portion, a magnetic pole structure disposed within the hollow interior portion of the roller, a gap forming member, and a blocking member. The gap forming member is located within, and spaced from, the housing at a location downstream, in the rotation direction of the developing roller, of the opening in the wall of the housing, forms a first gap with respect to the developing roller and forms a second gap with respect to the housing. The gap forming member has a first side facing the opening in the wall of the housing and a second side spaced inwardly of the housing, from the first wall. The blocking member is located in the first gap and at one of the first and second sides of the gap forming member.

20 Claims, 16 Drawing Sheets

(56) References Cited

U.S. PATENT DOCUMENTS

| | | | | |
|---|---|---|---|---|
| 2015/0093139 | A1* | 4/2015 | Kuramoto ..... | G03G 15/0806 399/92 |
| 2017/0205731 | A1 | 7/2017 | Takahashi | |

FOREIGN PATENT DOCUMENTS

| | | | |
|---|---|---|---|
| JP | 2001183903 | A | 7/2001 |
| JP | 2005274698 | A | 10/2005 |

* cited by examiner

DEVELOPING DEVICE WITH A GAP FORMING MEMBER AND IMAGE FORMING APPARATUS HAVING THE SAME

CROSS-REFERENCE TO RELATED APPLICATION

This application is based upon and claims the benefit of priority from Japanese Patent Application No. 2017-138218, filed Jul. 14, 2017, the entire contents of which are incorporated herein by reference.

FIELD

Embodiments described herein relate generally to a developing device and an image forming apparatus.

BACKGROUND

Conventionally, there is an image forming apparatus such as a multi-function peripheral (hereinafter referred to as a "MFP") and a printer. The image forming apparatus has a developing device accommodating a developer therein. The developing device includes a developing roller. If air enters the developing device due to rotation of the developing roller, the pressure in the developing device increases. As the pressure in the developing device increases, the air containing a toner in the developing device spouts from the developing device. If the air containing the toner spouts from the developing device, the toner scatters outside the developing device and there is a possibility that the functional components such as a charging device become contaminated with the toner.

DETAILED DESCRIPTION

In accordance with an embodiment, a developing device includes a housing having an opening in a wall thereof, a developing roller having a hollow interior portion and an axis of rotation, rotatably arranged within the housing to rotate in a rotation direction about the axis of rotation, a gap forming member, and a blocking member. The magnetic pole structure is disposed within the hollow interior portion of the roller, at least a portion thereof facing the opening in the wall of the housing, wherein the developing roller is configured to carry a developer on an outer surface thereof using magnetic force of the magnetic pole structure. The gap forming member is located within, and spaced from, the housing at a location downstream, in the rotation direction of the developing roller, of the opening in the wall of the housing, forms a first gap with respect to the developing roller and forms a second gap with respect to the housing, the gap forming member having a first side facing the opening in the wall of the housing and a second side spaced inwardly of the housing, from the first wall. The blocking member is located in the first gap and at one of the first and second sides of the gap forming member.

Hereinafter, an image forming apparatus of an embodiment is described with reference to the accompanying drawings. Further, in each figure, the same numerals are applied to the same components.

Figure 1:
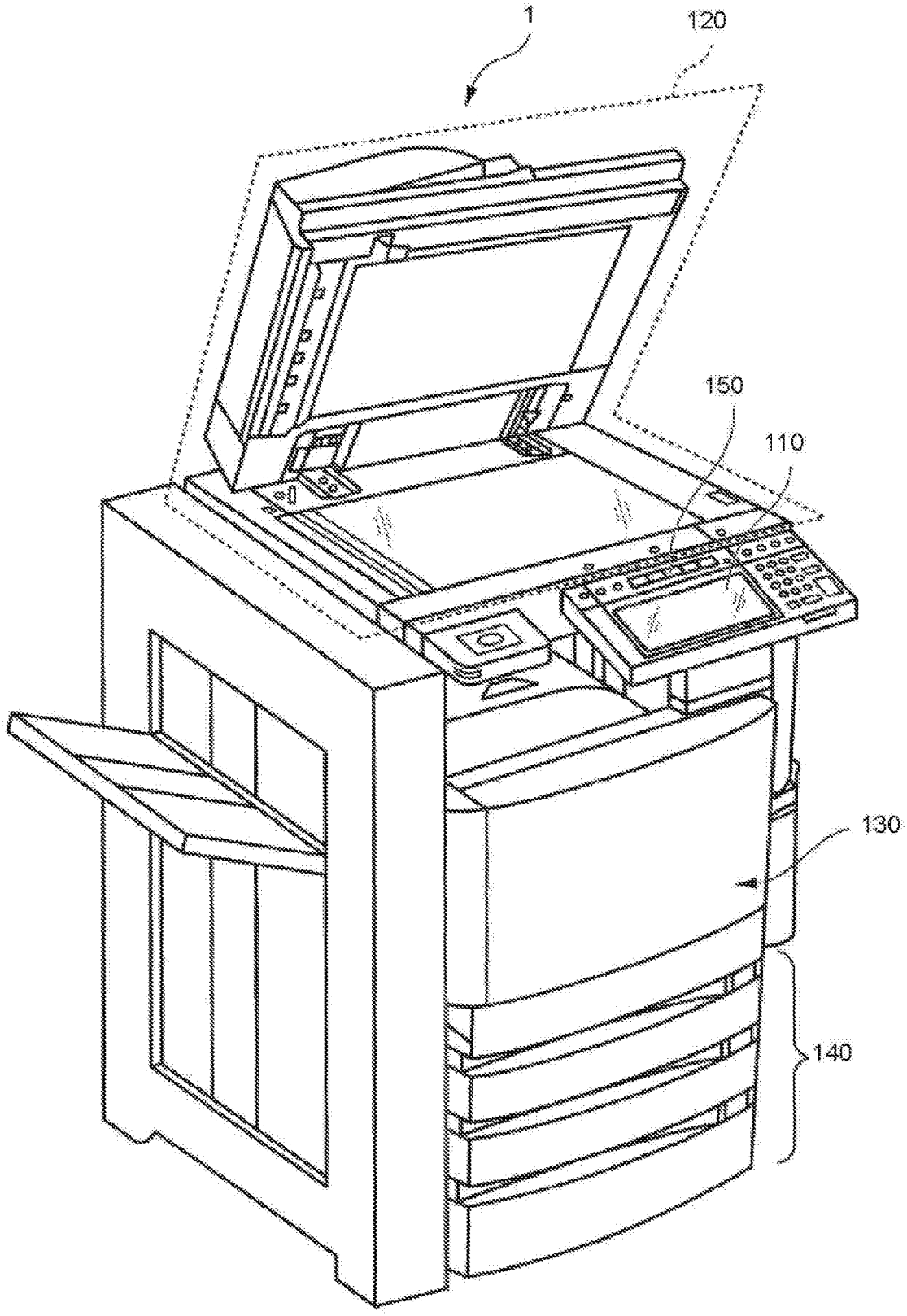
FIG. 1 is an external view illustrating an example of an image forming apparatus according to an embodiment.

FIG. 1 is an external view illustrating an example of an image forming apparatus 1 according to the embodiment. For example, the image forming apparatus 1 is a multi-function peripheral (an MFP). The image forming apparatus 1 reads an image formed on a sheet-like image receiving medium (hereinafter, referred to as a "sheet") such as a sheet of paper to generate digital data of the image, i.e., an image file. The image forming apparatus 1 forms an image on a different sheet with toner based on the digital data of the image file.

The image forming apparatus 1 is provided with a display section 110, an image reading section 120, an image forming section 130 and a sheet tray 140.

The display section 110 operates as an output interface to display characters and images. The display section 110 also operates as an input interface to receive an instruction from a user. For example, the display section 110 is a touch panel-type liquid crystal display.

For example, the image reading section 120 is a color scanner. In the color scanner, there is a CIS (Contact Image Sensor) and a CCD (Charge Coupled Device). The image reading section 120 reads the image formed on the sheet with a sensor to generate the digital data of the image file.

The image forming section 130 forms an image on the sheet with the toner. The image forming section 130 forms the image based on image data of the image file read by the image reading section 120 or image data received from an external device. For example, the image formed on the sheet is an output image referred to as hard copy, printout and the like.

The sheet tray 140 supplies the sheet used for image output to the image forming section 130.

Figure 2:
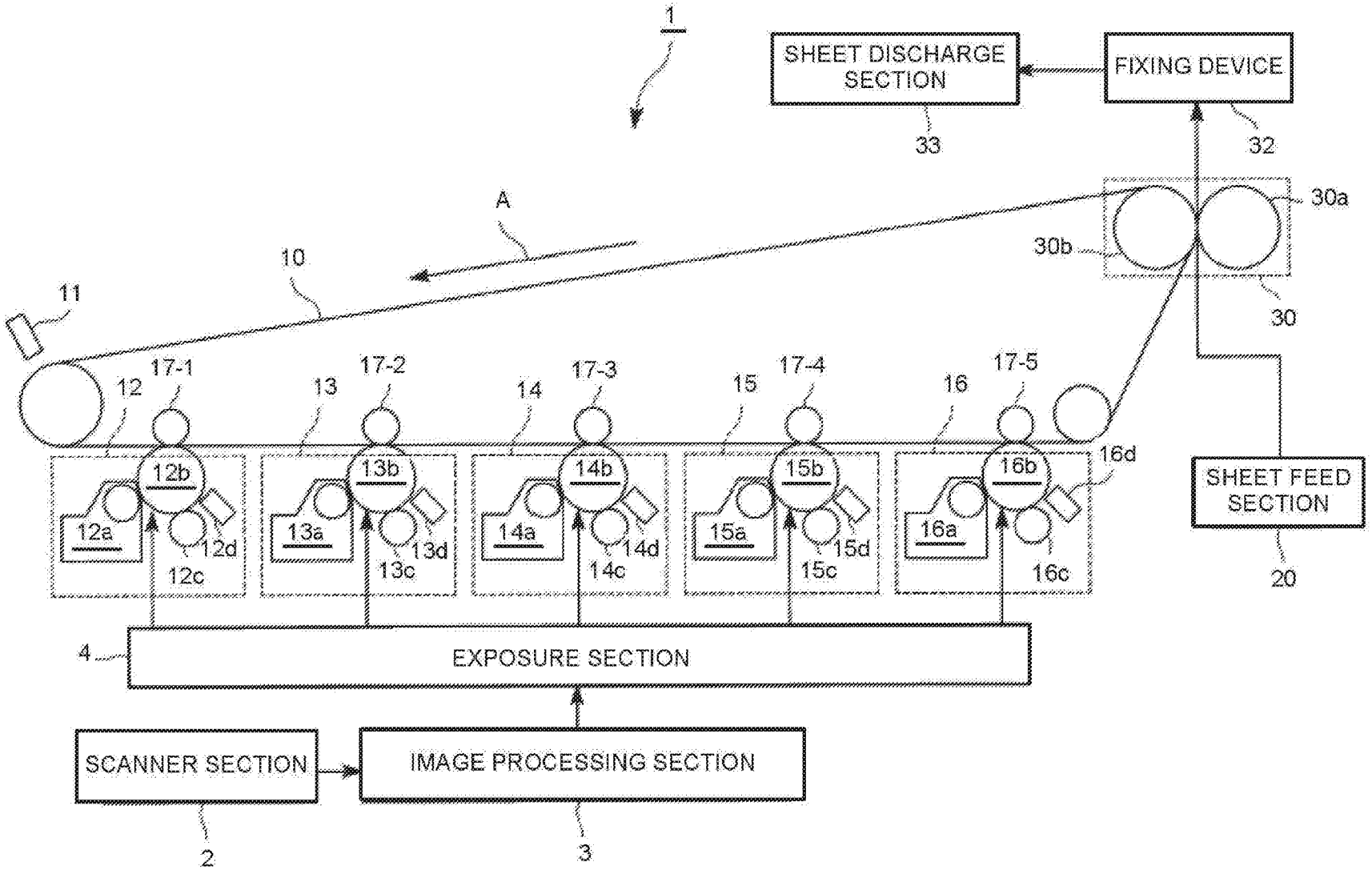
FIG. 2 is a schematic diagram of the image forming apparatus according to the embodiment.

FIG. 2 is a diagram illustrating an example of the schematic constitution of the image forming apparatus 1 according to the embodiment. The image forming apparatus 1 is an electrophotographic type image forming apparatus. The image forming apparatus 1 is a 5-tandem type image forming apparatus.

As examples of the toner, there is a decolorable toner, a non-decolorable toner (normal toner) and a decorative toner. The decolorable toner has decolorable characteristics due to external stimulus. "Decolorable" refers to a processing of making an image formed with a color (containing not only chromatic colors but also achromatic colors such as white, black and the like) different from a base color of the sheet invisible visually. For example, the external stimulus includes temperature, light with a specific wavelength and pressure. In the present embodiment, the decolorable toner is decolored upon reaching a specific decolorable temperature or higher. The decolorable toner develops a color upon reaching a specific restoration temperature or lower after being decolored.

The decolorable toner may be optional toner as long as it has the foregoing characteristics. For example, a coloring agent of the decolorable toner may be leuco dye. The decolorable toner may be a proper combination of a developer, a decolorable agent, discoloration-temperature regulator and the like.

Further, a fixing temperature of the decolorable toner is lower than that of the non-decolorable toner. Here, the fixing temperature of the decolorable toner means a temperature of a heat roller 40 in a decolorable toner mode described later. The fixing temperature of the non-decolorable toner means a temperature of the heat roller 40 in a monochrome toner mode or a color toner mode described later.

The fixing temperature of the decolorable toner is lower than a temperature of a decoloring processing of the decolorable toner. Here, a temperature of the decoloring processing of the decolorable toner means the temperature of the heat roller 40 in the decoloring mode described later.

The image forming apparatus 1 is provided with a scanner section 2, an image processing section 3, an exposure section 4, an intermediate transfer body 10, a cleaning blade 11, image forming sections 12~16, primary transfer rollers 17-1~17-5, a sheet feed section 20, a secondary transfer section 30, a fixing device 32, a sheet discharge section 33 and a controller (not shown). Hereinafter, if all the primary transfer rollers are not distinguished, they are simply represented as a primary transfer roller 17.

In the following description, since the sheet is conveyed from the sheet feed section 20 to the sheet discharge section 33, the sheet feed section 20 side is set as an upstream side with respect to a sheet conveyance direction Vs and the sheet discharge section 33 side is set as a downstream side with respect to the sheet conveyance direction Vs.

Transfer processes in the image forming apparatus 1 include a first transfer process and a second transfer process. In the first transfer process, the primary transfer roller 17 transfers an image by the toner on a photoconductive drum of each image forming section onto the intermediate transfer body 10. In the second transfer process, the secondary transfer section 30 transfers the image by the toner of each color laminated on the intermediate transfer body 10 onto the sheet.

The scanner section 2 reads the image formed on the sheet which is a scanned object. For example, the scanner section 2 reads the image on the sheet to generate image data of three primary colors, i.e., red (R), green (G) and blue (B). The scanner section 2 outputs the generated image data to the image processing section 3.

The image processing section 3 converts the image data to color signals of respective colors. For example, the image processing section 3 converts the image data to image data (color signals) of four colors, i.e., yellow (Y), magenta (M), cyan (C) and black (K). The image processing section 3 controls the exposure section 4 based on the color signal of each color.

The exposure section 4 irradiates (exposes) the photoconductive drum of the image forming section with light. The exposure section 4 is provided with an exposure light source such as a laser, an LED and the like.

The intermediate transfer body 10 is an endless belt. The intermediate transfer body 10 rotates in an arrow A direction shown in FIG. 2. The toner image is formed on the surface of the intermediate transfer body 10.

The cleaning blade 11 removes the toner adhering to the intermediate transfer body 10 after the toner image is transferred to a sheet. For example, the cleaning blade 11 is a plate-like member. For example, the cleaning blade 11 is made from resin such as urethane resin.

The image forming sections 12~16 form images with toner of respective colors (five colors in the example shown in FIG. 2). The image forming sections 12~16 are arranged in order along the intermediate transfer body 10.

The primary transfer roller 17 (17-1~17-5) is used at the time of transferring the image by the toner formed by each of the image forming sections 12~16 onto the intermediate transfer body 10.

The sheet feed section 20 feeds the sheet.

The secondary transfer section 30 is provided with a secondary transfer roller 30*a* and an opposed secondary transfer roller 30*b*. The secondary transfer section 30 transfers the image, using the toner formed on the intermediate transfer body 10, onto the sheet.

In the secondary transfer section 30, the intermediate transfer body 10 contacts the secondary transfer roller 30*a*. From the viewpoint of improving a sheet jam, the intermediate transfer body 10 may be separated from the secondary transfer roller 30*a*.

The fixing device 32 fixes the image of the toner transferred onto the sheet by heating and pressurizing the toner image. The sheet on which the image is fixed by the fixing device 32 is discharged from the sheet discharge section 33 to the outside of the apparatus.

Next, the image forming sections 12~16 are described. The image forming sections 12~15 respectively house the toner of respective colors corresponding to four colors for color printing. The four colors for color printing include yellow (Y), magenta (M), cyan (C) and black (K). The toner of the four colors for color printing is the non-decolorable toner. The image forming section 16 houses the decolorable toner. The image forming sections 12~15 and the image forming section 16 have the same constitution except that the toner housed therein is different. Thus, the image forming section 12 is described representing the image forming sections 12~16, and the description of the other image forming sections 13~16 is omitted as redundant.

The image forming section 12 is provided with a developing device 12*a*, formed for example as a replaceable cartridge, a photoconductive drum 12*b*, a charging device 12*c* and a cleaning blade 12*d*.

The developing device 12*a* houses a developer. The toner is included in the developer. The developing device 12*a* enables the toner to adhere to the photoconductive drum 12*b*. For example, the toner is used as a one-component developer or as a two-component developer in combination with a carrier. For example, an iron powder or a polymer ferrite particle having a particle diameter of several tens of μm is used as the carrier. In the embodiment, a two-component developer containing a non-magnetic toner and the iron powder or a polymer ferrite is used.

The photoconductive drum 12*b* is one of concrete examples of an image carrier (image carrying module). The photoconductive drum 12*b* includes a photoconductor (photoconductive area) on the outer peripheral surface thereof. For example, the photoconductor is an organic photoconductor (OPC).

The charging device 12*c* uniformly charges the surface of the photoconductive drum 12*b*.

The cleaning blade 12*d* removes the toner adhering to the photoconductive drum 12*b*.

Next, the schematic operations of the image forming section 12 are described.

The photoconductive drum 12*b* is charged to a predetermined potential by the charging device 12*c*. Next, light is emitted from the exposure section 4 to the photoconductive drum 12*b*. In this way, the electric potential at the area on the photoconductive drum 12*b* irradiated with the light changes. Through the change, an electrostatic latent image is formed on the surface of the photoconductive drum 12*b*. The electrostatic latent image on the surface of the photoconductive drum 12*b* is developed by the developer in the developing device 12*a*. In other words, an image (hereinafter, referred to as a "developed image") developed by the toner is formed on the surface of the photoconductive drum 12*b*.

The developed image formed on the surface of the photoconductive drum 12*b* is transferred onto the intermediate transfer body 10 by the primary transfer roller 17-1 on the side thereof opposite from the photoconductive drum 12*b* (first transfer process).

Next, the first transfer process by the image forming apparatus 1 is described. Firstly, the primary transfer roller 17-1 opposite to the photoconductive drum 12*b* caused transfer of the developed image on the photoconductive drum 12*b* onto the intermediate transfer body 10. Next, the primary transfer roller 17-2 opposite to a photoconductive drum 13*b* causes transfer of the developed image on the photoconductive drum 13*b* onto the intermediate transfer body 10. Such a processing is also carried out for photoconductive drums 14*b*, 15*b* and 16*b*. At this time, the developed images on the photoconductive drums 12*b*~16*b* are respectively transferred onto the intermediate transfer body 10 to overlap with each other. Thus, the developed images represented as the toner of respective colors are overlapped while being transferred onto the intermediate transfer body 10 after passing through the image forming section 16.

However, in a case in which image formation using only the non-decolorable toner is carried out, the image forming sections 12~15 operate. Through such an operation, the developed images using only the non-decolorable toner are formed on the intermediate transfer body 10. Further, in a case in which image formation using only the decolorable toner is carried out, the image forming section 16 operates. Through such an operation, the developed image using only the decolorable toner is formed on the intermediate transfer body 10.

Next, the second image transfer process is described. A voltage (bias) is applied to the secondary transfer roller 30*a* opposite secondary transfer roller 30*b*. Thus, an electric field is generated between the secondary transfer roller 30*b* and the secondary transfer roller 30*a*. As a result of the electric field, the secondary transfer section 30 transfers the developed image formed on the intermediate transfer body 10 onto a sheet passing between the intermediate transfer body and the secondary transfer roller 30*a*.

The fixing device 32 is described below.

Figure 3:
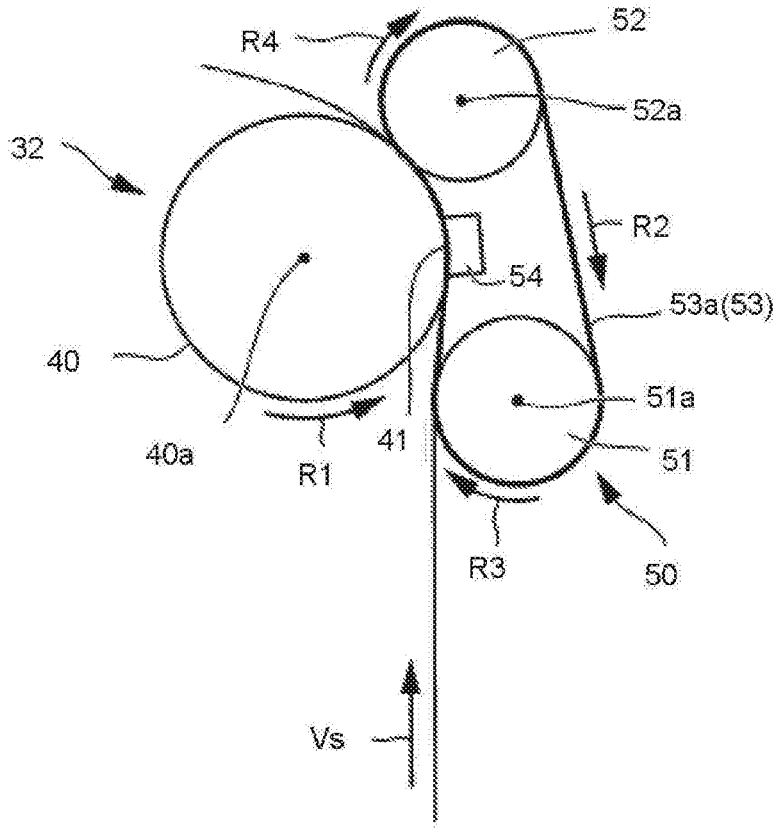
FIG. 3 is a schematic diagram of a fixing device according to the embodiment.

FIG. 3 is a diagram illustrating an example of the schematic constitution of the fixing device 32 according to the embodiment.

As shown in FIG. 3, the fixing device 32 is provided with the heat roller 40 (heating section) and a pressure unit 50.

Firstly, the heat roller 40 which is a heating unit is described.

The heat roller 40 is arranged at the downstream side of the image forming section 130 (specifically, the secondary transfer section 30 shown in FIG. 2) in the sheet conveyance direction Vs. The heat roller 40 is holdable at two target temperatures described later. The heat roller 40 is an endless fixing member. The heat roller 40 includes a curved outer peripheral surface. In other words, the heat roller 40 is formed into a cylindrical shape. The heat roller 40 includes a metal roller. For example, the heat roller 40 includes a resin layer such as fluorine resin on the outer peripheral surface of an aluminum roller. The heat roller 40 is rotatable around a first axis 40*a*. The first axis 40*a* refers to a central axis (rotation axis) of the heat roller 40.

The fixing device 32 is further provided with a heat source (not shown) for heating the heat roller 40. For example, the heat source may be a resistance heat generating body such as a thermal head, a ceramic heater, a halogen lamp, an electromagnetic induction heating unit and the like. The heat source may be arranged inside the heat roller 40 or outside the heat roller 40.

The pressure unit 50 is described below.

The pressure unit 50 is provided with a plurality of rollers 51 and 52, a belt 53 (rotating body) and a pressure pad 54 (pressure member).

A plurality of the rollers 51 and 52 is arranged at the inside of the belt 53. In the embodiment, a plurality of the rollers 51 and 52 is composed of a first roller 51 and a second roller 52. A plurality of the rollers 51 and 52 may be the same roller or different rollers.

A plurality of the rollers 51 and 52 is rotatable respectively around a plurality of rotation axes 51*a* and 52*a* parallel to the first axis 40*a*. A plurality of the rollers 51 and 52 is arranged at positions contributing to formation of a nip 41.

The first roller 51 is arranged at the upstream side in the sheet conveyance direction Vs with respect to the second roller 52. The first roller 51 is formed into a cylindrical shape. For example, the first roller 51 is a roller made from metal such as iron. The first roller 51 is rotatable around the first rotation axis 51*a* parallel to the first axis 40*a*. The first rotation axis 51*a* refers to the central axis of the first roller 51.

The second roller 52 is arranged at the downstream side in the sheet conveyance direction Vs with respect to the first roller 51. The second roller 52 is formed into a cylindrical shape. For example, the second roller 52 is a roller made from metal such as iron. The second roller 52 is rotatable around the second rotation axis 52*a* parallel to the first axis 40*a*. The second rotation axis 52*a* refers to the central axis of the second roller 52.

The belt 53 faces the heat roller 40. The belt 53 is stretched over the first roller 51 and the second roller 52. The belt 53 is formed into an endless shape.

The belt 53 is provided with a base layer 53*a* and a release layer (not shown). For example, the base layer 53*a* is formed by polyimide resin (PI). For example, the release layer is formed by fluorine resin such as tetrafluoroethylene-perfluoroalkyl vinyl ether copolymer resin (PFA). The layer structure of the belt 53 is not limited.

A film-like member is included in the belt 53.

The pressure pad 54 is formed into a right-angled parallelepiped shape. For example, the pressure pad 54 is formed by a resin material such as heat-resistant PPS (Polyphenylene Sulfide Resin), LCP (Liquid Crystal Polymer), PF (Phenol Resin) and the like. The pressure pad 54 is arranged at a position opposite to the heat roller 40 across the belt 53. The pressure pad 54 is energized towards the heat roller 40 through an energization member such as a spring (not shown). The pressure pad 54 abuts against the inner peripheral surface of the belt 53 to push the belt 53 against the heat roller 40 to form the nip 41. In other words, the pressure pad 54 presses the inner peripheral surface of the belt 53 towards the heat roller 40 to form the nip 41 between the belt 53 and the heat roller 40.

The rotation direction of the heat roller 40 is described below.

The heat roller 40 rotates in an arrow R1 direction driven by a motor (not shown). The heat roller 40 rotates in the arrow R1 direction independently of the pressure unit 50.

The belt 53 is driven by the heat roller 40 to rotate in an arrow R2 direction. The belt 53 is driven to rotate by abutting against the outer peripheral surface of the heat roller 40 rotating in the arrow R1 direction.

The first roller 51 is driven by the belt 53 to rotate in an arrow R3 direction. The second roller 52 is driven by the belt 53 to rotate in an arrow R4 direction. The first roller 51 and the second roller 52 are driven to rotate by abutting against the inner peripheral surface of the belt 53 rotating in the arrow R2 direction.

Next, types of the image forming processing carried out by the image forming apparatus 1 (refer to FIG. 1) of the embodiment are described. The image forming apparatus 1 carries out printing in three modes shown below.

Monochrome toner mode: forming an image with non-decolorable black monochromatic toner.

Color toner mode: forming an image with non-decolorable monochrome toner and color toner.

Decolorable toner mode: forming an image with only the decolorable toner.

The kind of mode in which the image formation is carried out can be selected according to an operation of the user on the display section 110 of the image forming apparatus 1.

In the monochrome toner mode, the image forming section using the non-decolorable toner of black (K) operates to form an image. The monochrome toner mode is selected in a case in which the user wants to print a general monochrome image. For example, the monochrome toner mode is used in a case in which the user wants to keep a paper as important data without reusing the paper.

In the color toner mode, four image forming sections respectively using the non-decolorable toner of yellow (Y), magenta (M), cyan (C) and black (K) operate to form images. The color toner mode is selected in a case in which the user wants to print a color image.

In the decolorable toner mode, only the image forming section using the decolorable toner operates to form an image. The decolorable toner mode is selected in a case in which the user wants to reuse a paper on which an image is formed.

The fixing device 32 is controlled in a fixing mode and a decoloring mode. In the fixing mode, the toner image is fixed on the sheet. In the decoloring mode, the toner image is decolored from the sheet. In the decoloring mode, the temperature of the heat roller 40 is higher than that of the heat roller 40 in the fixing mode. The controller (not shown) operates the fixing device 32 at least two or more target temperatures. Specifically, two target temperatures of the fixing device 32 are stored in a memory (not shown). The controller calls out the target temperature from the memory according to the selected mode and operates the fixing device 32 at that temperature. The two target temperatures are a first temperature and a second temperature. Here, the first temperature is a temperature in the decoloring mode. The second temperature is a temperature in the fixing mode. The second temperature is lower than the first temperature. As shown in FIG. 1, the display section 110 includes a button 150 (operation section) for switching the fixing device 32 from the decoloring mode to the fixing mode.

Next, the developing device 12*a* is described.

Figure 4:
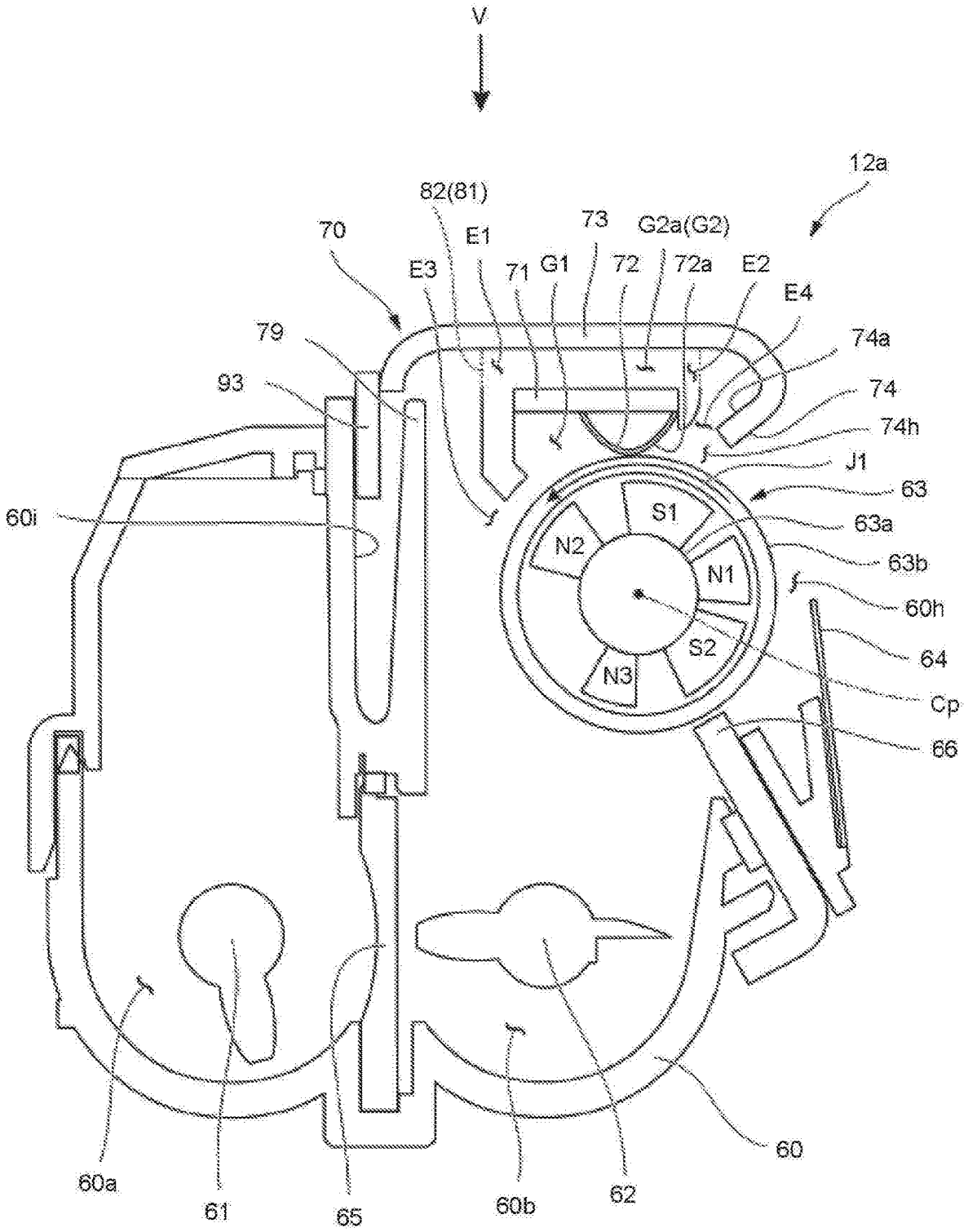
FIG. 4 is a schematic cross-sectional view of a developing device according to the embodiment.

FIG. 4 is a cross-sectional view illustrating an example of the schematic constitution of the developing device 12*a* according to the embodiment. In FIG. 4, cross-section hatching is omitted.

As shown in FIG. 4, the developing device 12*a* includes a housing 60, a first mixer 61, a second mixer 62, a developing roller 63, a shielding section 64, a gap forming member 71, a blocking member 72 and a guide section 74.

The housing 60 houses the developer. The developer is composed of a carrier which is a magnetic body and the toner which is the coloring material. At the inside of the housing 60, the first mixer 61 and the second mixer 62 are arranged. At a side facing the photoconductive drum 12*b* (refer to FIG. 2) in the housing 60, an opening 60*h* which exposes a part of the developing roller 63 is formed. In the present embodiment, the housing 60 constitutes the developing device 12*a*, but may also include a frame of the image forming apparatus 1 other than the developing device 12*a*. The housing 60 and the gap forming member 71 may be integrally molded or formed as separate members.

Figure 5:
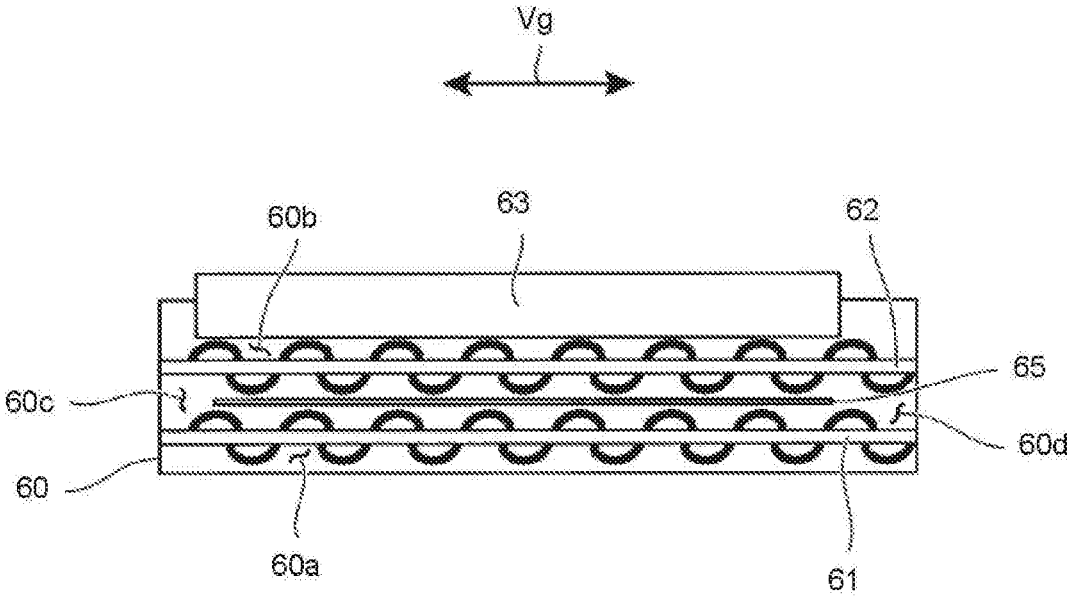
FIG. 5 is a view of the developing device along an arrow V in FIG. 4.

FIG. 5 is a view from the direction of an arrow V in FIG. 4 schematically illustrating internal features of the housing where illustration of the gap forming member 71 and the blocking member 72 is omitted.

As shown in FIG. 5, the first mixer 61 and the second mixer 62 are arranged parallel to each other along their length directions. The first mixer 61 functions as a developer stirring section that stirs the developer. The second mixer 62 functions as the developer supply section for supplying the developer to the developing roller 63.

In the housing 60, a first chamber 60*a* in which the first mixer 61 is arranged is formed. In the housing 60, a second chamber 60*b* in which the second mixer 62 is arranged is formed. The housing 60 is provided with a partition wall 65 for partitioning the first chamber 60*a* and the second chamber 60*b*. The first chamber 60*a* and the second chamber 60*b* are adjacent to each other across the partition wall 65. Side openings 60*c* and 60*d* for circulating the developer between the first chamber 60*a* and the second chamber 60*b* are formed at the opposite ends, in a rotation axis direction Vg, of the developing roller 63 in the housing 60. That is, the length of the partition 65 is shorter than the internal space of the housing 60 in the rotation axis direction Vg. According to this configuration, side openings 60*c* and 60*d* are formed between ends of the partition 65 and internal surfaces of the housing 60. The developer contained in the housing 60 can circulate between the first chamber 60*a* and the second chamber 60*b* through the side openings 60*c* and 60*d*. Hereinafter, the rotation axis direction Vg of the developing roller 63 is also referred to as a "roller axial direction Vg".

As shown in FIG. 4, the developing roller 63 is rotatably arranged in the housing 60. The developing roller 63 carries the developer on the surface thereof using magnetic attraction of the magnetic material in the developer toward the roller based on a magnetic field at the surface of the roller. The developing roller 63 faces the photoconductive drum 12*b* (refer to FIG. 2) through the opening 60*h*. The developing roller 63 is arranged at the second chamber 60*b* side of the housing 60.

The developing roller 63 includes a shaft 63*a*, a plurality of magnetic pole sections N1, S1, N2, N3 and S2, and a sleeve 63*b*.

The shaft 63*a* extends in the roller axial direction Vg (refer to FIG. 5). Both ends of the shaft 63*a* are fixed to the housing 60 such that the shaft 63*a* is stationary.

A plurality of the magnetic pole sections N1, S1, N2, N3 and S2 is fixed to the shaft 63*a*. A plurality of the magnetic pole sections N1, S1, N2, N3 and S2 is fixed at fixed positions at intervals in a circumferential direction of the shaft 63*a*. For example, the magnetic pole sections N1, S1, N2, N3 and S2 are magnets.

The magnetic pole sections N1, S1, N2, N3 and S2 are a development pole N1, a first conveyance pole S1, a peeling pole N2, a grip pole N3 and a second conveyance pole S2. The development pole N1 faces the photoconductive drum 12*b* across the sleeve 63*b* to enable the developer carried on the developing roller 63 to approach the photoconductive drum 12*b* (refer to FIG. 2). The plurality of the magnetic pole sections N1, S1, N2, N3 and S2 is arranged in the order of the first conveyance pole S1, the peeling pole N2, the grip pole N3 and the second conveyance pole S2 towards the downstream side of a rotation direction J1 of the developing roller 63 based on the development pole N1. Hereinafter, the rotation direction J1 of the developing roller 63 is also referred to as a "roller rotation direction J1". The development pole N1, the peeling pole N2 and the grip pole N3 are N poles. The first conveyance pole S1 and the second conveyance pole S2 are S poles.

The first conveyance pole S1 is a magnetic pole section in the housing which is positioned inside the housing 60 at the most upstream side of the roller rotation direction J1. The first conveyance pole S1 is positioned at the most upstream side in the roller rotation direction J1 at the inside of the housing 60 which is on the downstream side of the roller rotation direction J1 with respect to the position where the developing roller 63 faces the photoconductive drum 12*b* (refer to FIG. 2).

The sleeve 63*b* is formed into a cylindrical shape including the shaft 63*a* and the plurality of the magnetic pole sections N1, S1, N2, N3, and S2 therein. The sleeve 63*b* is rotatable with respect to the magnetic pole sections N1, S1, N2, N3, and S2 by a driving source (not shown). The sleeve 63*b* rotates counterclockwise (in the arrow J1 direction). In FIG. 4, the photoconductive drum 12*b* (refer to FIG. 2) rotates clockwise opposite to the rotation direction J1 (the roller rotation direction J1) of the sleeve 63*b*.

The developer moves, along with the developing roller 63, by the rotation of the sleeve 63*b*. The developer on the developing roller can be lifted from the developing roller by magnetic force at the time of passing over the magnetic pole sections N1, S1, N2, N3 and S2. By the lifting of the developer, the toner is separated from the developer and a toner cloud occurs. The toner cloud contributes to toner scattering.

Developer in the second chamber 60*b* becomes adhered to the developing roller 63 by virtue of the magnetic force of the grip pole N3. The developer attached to the developing roller 63 is conveyed to the development pole N1, after passing the second conveyance pole S2. The development pole N1 forms a developing area. In the developing area, the toner contained in the developer moves from the developing roller 63 to the photoconductive drum 12*b* (refer to FIG. 2). The developed image is formed by the toner on the surface of the photoconductive drum 12*b*. After the developed image is formed on the surface of the photoconductive drum 12*b*, the developer is conveyed to the peeling pole N2, after passing the first conveyance pole S1. Due to the repelling effect of the magnetic force on the developer between the peeling pole N2 and the grip pole N3, the developer adhering to the developing roller 63 is peeled off of the developing roller 63.

The spacing between a doctor blade 66 of the opening 60*h* in the housing 60 and the surface of the developing roller 63 regulates the layer thickness of the developer carried by the developing roller 63.

The shielding section 64 blocks the flow of the air from the developing device 12*a* to the photoconductive drum 12*b* (refer to FIG. 2). The shielding section 64 is arranged between the doctor blade 66 and the photoconductive drum 12*b*. The shielding section 64 extends from the housing 60 so as to block a gap between the doctor blade 66 and the developing roller 63 from the line of sight of the photoconductive drum 12*b*.

The gap forming member 71 forms a first gap G1 with the developing roller 63. The gap forming member 71 faces the developing roller 63 across the first gap G1. The gap forming member 71 is positioned at the opposite side of the developing roller 63 from the second mixer 62. The gap forming member 71 forms a second gap G2 between itself and the housing 60. The gap forming member 71 faces the housing 60 across the second gap G2. Hereinafter, a portion 73 of the housing 60 which faces the gap forming member 71 through the second gap G2 is also referred to as a "casing main body 73". The gap forming member 71 extends in the roller axial direction Vg (refer to FIG. 6).

Figure 6:
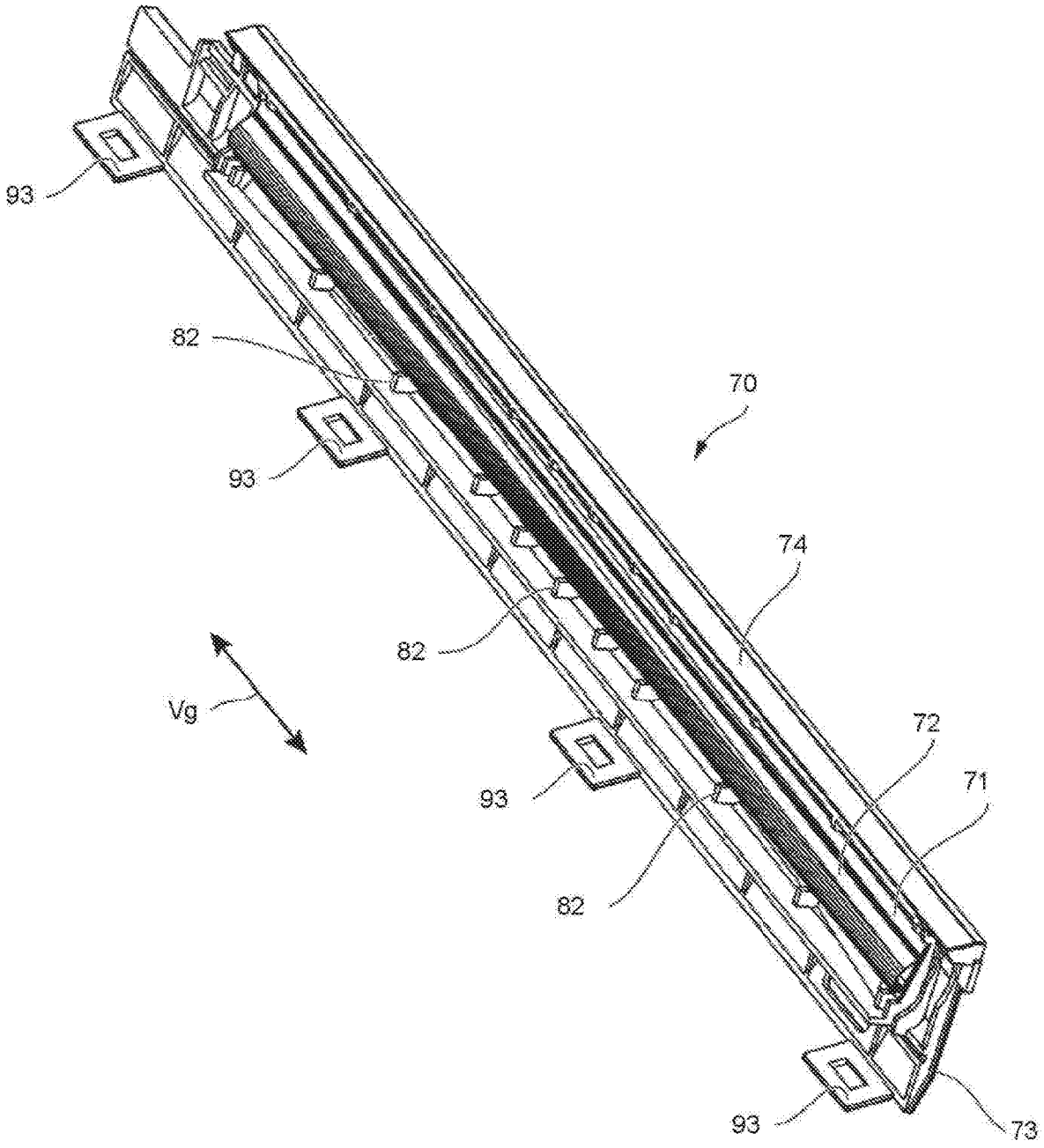
FIG. 6 is a perspective view illustrating a blocking member together with a casing main body according to the embodiment.
Figure 7:
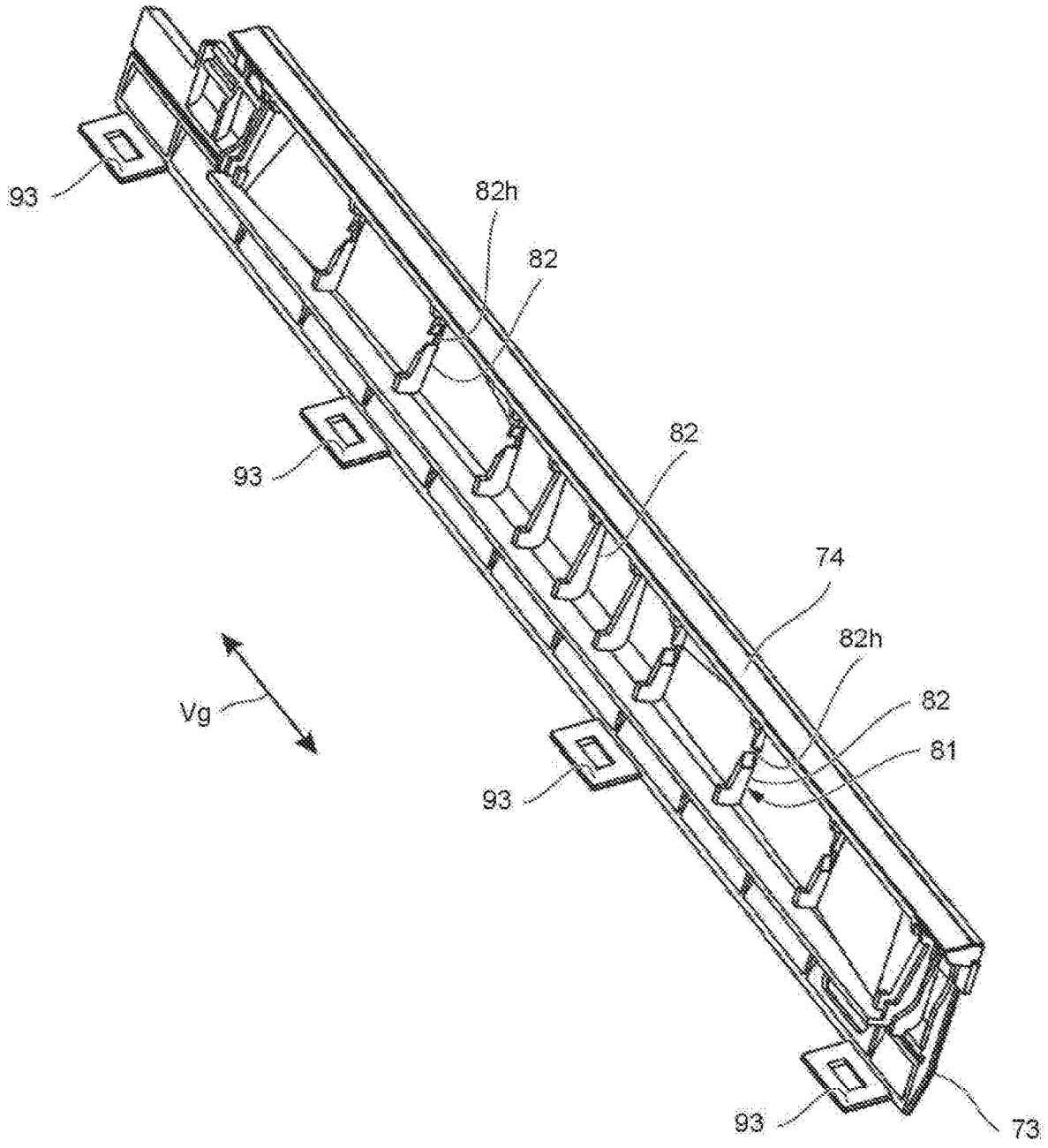
FIG. 7 is a perspective view illustrating the casing main body according to the embodiment.

FIG. 6 is a perspective view illustrating the blocking member 72 together with the casing main body 73 according to the embodiment. FIG. 7 is a perspective view illustrating the casing main body 73 according to the embodiment.

As shown in FIG. 7, in the casing main body 73, a holding section 81 and an engagement section 93 are arranged. For example, the casing main body 73, the holding section 81 and the engagement section 93 are integrally formed of the same member.

The casing main body 73 is formed into a plate shape extending in the roller axial direction Vg. The holding section 81 extends from the casing main body 73 towards the gap forming member 71 (refer to FIG. 4) to hold the gap forming member 71. The holding section 81 includes a plurality of ribs 82 arranged at intervals in the roller axial direction Vg. A notch 82*h* is formed in the ribs 82 located toward the outer sides of the holding section in the roller axial direction Vg.

As shown in FIG. 4, the blocking member 72 is arranged in the first gap G1. The blocking member 72 is arranged between the gap forming member 71 and the developing roller 63. The blocking member 72 is arranged at the downstream side, in the roller rotation direction J1, with respect to the development pole N1. The blocking member 72 is formed into a loop or convex shape. The blocking member 72 is supported by the gap forming member 71. As shown in FIG. 6, the blocking member 72 extends in the roller axial direction Vg. The blocking member 72 is attached to the ribs 82 with the gap forming member 71. For example, a double-sided tape (not shown) is arranged on the gap forming member 71. For example, the blocking member 72 is attached to the rib 82 by the double-sided tape of the gap forming member 71.

As shown in FIG. 4, by arranging a part of the blocking member 72 in contact with the developing roller 63, as the developing roller 63 rotates, the blocking member 72 provides a wall to block airflow from flowing into the inside of the developing device 12*a* through the gap 74*h* and along the outer peripheral surface of the developing roller 63. The first gap G1 is a gap between the developing roller 63 and the gap forming member 71. The blocking member 72 has the function of a valve for blocking the flow of air including the toner which flows in an opposite direction to the roller rotation direction J1 which would otherwise go out of the housing 60 to the outside of the housing 60 through the first gap G1. The blocking member 72 contacts a developer layer (not shown) on the developing roller 63 at a sufficiently low pressure that it does not hinder the development conveyance of the developing roller 63. The blocking member 72 does not completely hinder the flow of the airflow, but rate-limits the flow of the airflow. The blocking member 72 facilitates an airflow circulating around the gap forming member 71 and contributes to the flow centered on the generated airflow in the developing device 12*a*. The blocking member 72 is curved convexly towards the developing roller 63. The blocking member 72 has flexibility. For example, the blocking member 72 is an elastic body such as urethane.

The blocking member 72 is arranged at a position facing the first conveyance pole S1 which is the magnetic pole section at the most upstream side in the housing at the inside of the housing 60. The blocking member 72 is arranged at a position overlapping with the first conveyance pole S1 in a direction normal to the outer surface of the developing roller 63. The portion of the blocking member 72 closest to the first conveyance pole S1 is arranged over the far end of the first conveyance pole S1 in the roller rotation direction J1.

At a portion of the blocking member 72 which faces the developing roller 63 and is located at the upstream side in the roller rotation direction J1 from the portion of the blocking member 72 closest to the first conveyance pole S1, a surface 72*a* which is inclined towards a position where the blocking member 72 contacts with the developer layer (not shown) is arranged. For example, the inclined surface 72*a* forms an angle equal to or greater than 1 degree and equal to or smaller than 45 degrees with respect to a tangent of the developing roller 63 at the location where the blocking member 72 is closest to the first conveyance pole S1.

Between the casing main body 73 and the gap forming member 71, a first opening E1 and a second opening E2 are arranged.

The first opening E1 is formed at the downstream side, in the roller rotation direction J1, with respect to the gap forming member 71. The first opening E1 is positioned at the downstream side of the roller rotation direction J1 in the second gap G2.

The second opening E2 communicates with the first opening E1 through the second gap G2. The second opening E2 is formed at the upstream side, in the roller rotation direction J1, of the gap forming member 71. The second opening E2 is positioned at the upstream side, in the roller rotation direction J1, of the second gap G2.

At the downstream side in the roller rotation direction J1 of the blocking member 72 with respect to the second opening E2, a third opening E3 is formed. The third opening E3 communicates with the downstream side, in the roller rotation direction J1, of the first gap G1. The third opening E3 is positioned in the vicinity of the peeling pole N2.

At the upstream side in the roller rotation direction J1 of the blocking member 72, a fourth opening E4 is formed. The fourth opening E4 communicates with the upstream side, in the roller rotation direction J1, of the first gap G1.

A part of the airflow passing through the blocking member 72 flows from the third opening E3 to the first opening E1. The airflow flowing to the first opening E1 flows to the second opening E2, passes through the fourth opening E4, and then again passes through the blocking member 72 during the rotation of the developing roller 63 in the direction J1. Thus, a circulating airflow is formed around the gap forming member 71. The gap forming member 71 has a function of affecting the airflow direction which determines the flow of airflow. Here, in the roller axial direction Vg, the width of the first opening E1 is set as W1, the width of the second opening E2 is set as W2, and the width of the third opening E3 is set as W3. In order to circulate the airflow smoothly, it is desirable that the widths W1, W2, and W3 of the respective openings E1, E2 and E3 have a relationship of W3>W1>W2. It is desirable that the opening area of the flow path decreases from the third opening E3 to the second opening E2 to and through the first opening E1.

The casing main body 73 is arranged opposed to the developing roller 63 with the gap forming member 71 member in between them. The second gap G2 is formed between the casing main body 73 and the gap forming member 71. The second gap G2 generally extends in the roller rotation direction J1. The second gap G2 communicates with the first gap G1 via the first opening E1 and the third opening E3 or the second opening E2 and the fourth opening E4.

Figure 8:
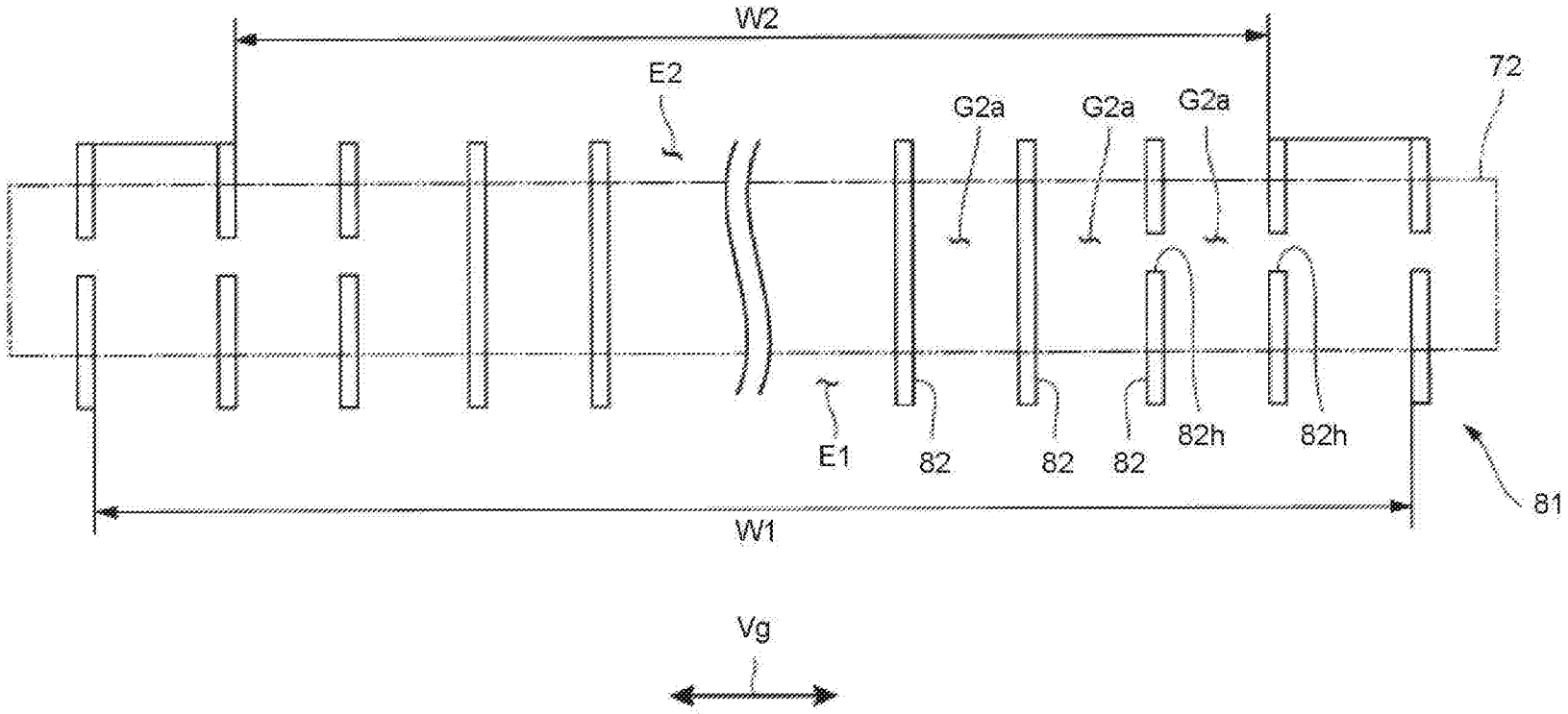
FIG. 8 is a plan view illustrating an example of a holding section according to the embodiment.

FIG. 8 is a plan view illustrating an example of the holding section 81 according to the embodiment. FIG. 8 is a diagram obtained by viewing the holding section 81 from the gap forming member 71 (refer to FIG. 7) side thereof. In FIG. 8, the blocking member 72 is indicated by a two-dot chain line.

As shown in FIG. 8, the holding section 81 includes a plurality of ribs 82 arranged at intervals in the roller axial direction Vg. The plurality of ribs 82 extends linearly in a direction orthogonal to the roller axial direction Vg as seen from the gap forming member 71 (refer to FIG. 7) side. A plurality of spaces G2*a* communicating the first opening E1 with the second opening E2 are formed by the plurality of ribs 82. The plurality of ribs 82 partitions the second gap G2 (refer to FIG. 4) to form the plurality of spaces G2*a*. A notch 82*h* opening in a direction parallel to the roller axial direction Vg is formed in the ribs 82 toward the outer ends of the holding section 81 in the roller axial direction Vg, as among the plurality of ribs 82. The notch 82*h* allows communication between a plurality of spaces G2*a* adjacent to each other with the ribs 82 interposed therebetween. In the example in FIG. 8, one notch 82*h* is formed in the ribs 82 having the notch 82*h*.

The first opening E1 and the second opening E2 are continuous in the roller axial direction Vg, as considered just outwardly of the opposed ends of the ribs 82. In the embodiment, the width W1 of the first opening E1 is the same as the width of the developing roller 63 (refer to FIG.

5). The width of the developing roller 63 (refer to FIG. 5) is a length of the developing roller 63 in the roller axial direction Vg. For example, the width W1 of the first opening E1 is about 310 mm.

In the roller axial direction Vg, the width W1 of the first opening E1 is larger than the width W2 of the second opening E2 (W1>W2). For example, a ratio W2/W1 of the width W1 of the first opening E1 to the width W2 of the second opening E2 is equal to or greater than 0.5. In addition, the ratio of W2 to Wt (width of the intermediate transfer body 10) is equal to or smaller than 0.76 (W2≤Wt×0.76).

Hereinafter, a length Z1 of the first opening E1 in an extending direction (height direction) of the holding section 81 is referred to as a "height Z1 of the first opening E1", and a length Z2 of the second opening E2 in the extending direction (height direction) of the holding section 81 is also referred to as a "height Z2 of the second opening E2". In other words, the extending direction of the holding section 81 is a direction orthogonal to the roller axial direction Vg, and is the opposite direction of the gap forming member 71 and the casing main body 73. The height Z1 of the first opening E1 and the height Z2 of the second opening E2 are specified by the interval between the casing main body 73 and the gap forming member 71 facing each other.

For example, the height Z1 of the first opening E1 and the height Z2 of the second opening E2 are preferably equal to or greater than 0.5 mm and equal to or smaller than 5.0 mm. It is further preferable that the height Z1 of the first opening E1 and the height Z2 of the second opening E2 are 1.0 mm or more.

As shown in FIG. 4, the engagement section 93 extends from the casing main body 73 into a recess 60*i* of the housing 60. By the engagement section 93, the casing main body 73 is detachably attached to the housing 60. The housing 60 is provided with a wall 79 forming the recess 60*i*. The wall 79 forms a the boundary of the communication path between the first opening E1 and the third opening E3 with the gap forming member 71.

As shown in FIG. 6, the casing main body 73 constitutes a cover unit 70 together with the gap forming member 71 and the blocking member 72. As shown in FIG. 4, the cover unit 70 covers the developing roller 63 on the side thereof opposite to the location of the second mixer 62. The cover unit 70 is detachably attached to the housing 60 by the engagement section 93.

The guide section 74 guides the airflow discharged from the second gap G2 via the second opening E2 between the blocking member 72 and the developing roller 63. The guide section 74 guides the air discharged from the second gap G2 through the second opening E2 toward the first gap G1. The guide section 74 has a guide surface 74*a* facing the gap forming member 71 across the fourth opening E4. The guide surface 74*a* is the inner surface of the guide section 74 that contacts the airflow guided by the guide section 74. The guide section 74 extends from the end near the second opening E2 in the housing 60 towards the developing roller 63. The guide section 74 extends from the end of the casing main body 73 at the opening 60*h* side thereof toward the developing roller 63. For example, the guide section 74 is integrally formed with the casing main body 73. A tip of the guide section 74 is spaced from the developing roller 63. Between the tip of the guide section 74 and the developing roller 63, a gap 74*h* is formed.

Figure 9:
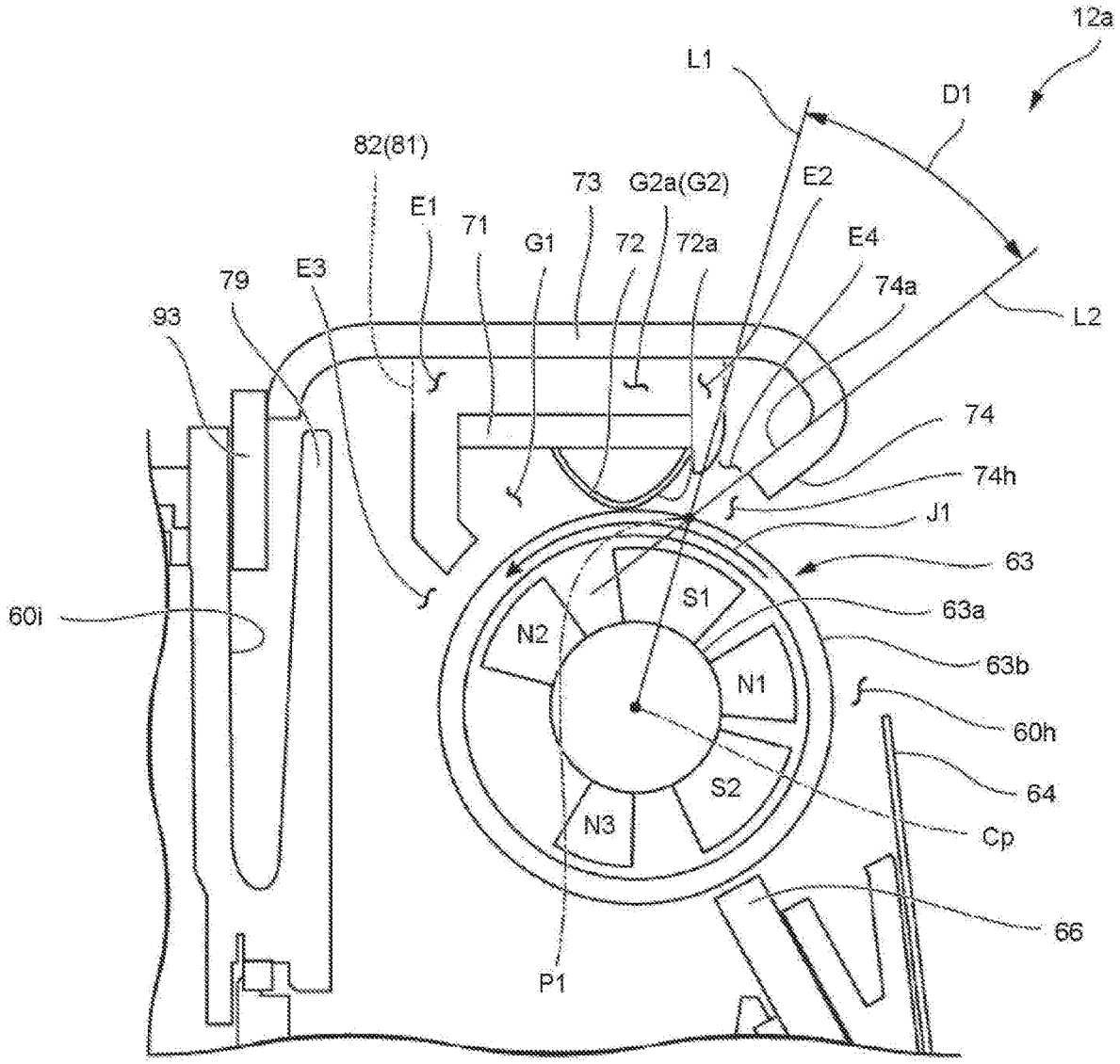
FIG. 9 is a cross-sectional view illustrating an example of a guide section according to the embodiment.

FIG. 9 is a cross-sectional view illustrating an example of the guide section 74 according to the embodiment. FIG. 9 is an enlarged view of a portion of the housing 60 in FIG. 4.

As shown in FIG. 9, a first virtual straight line L1 which is a reference line and a second virtual straight line L2 passing along the guide surface 74*a* are set. The first virtual straight line L1 is a virtual straight line passing through an intersection P1 between the second virtual straight line L2 and the outer surface of the developing roller 63 and the center of rotation Cp of the developing roller 63. An angle D1 formed between the first virtual straight line L1 and the second virtual straight line L2 if viewed from the roller axial direction Vg (refer to FIG. 5) is also referred to as an "angle D1 of the guide surface".

A direction in which the second virtual straight line L2 swings towards the upstream side of the roller rotation direction J1 with respect to the first virtual straight line L1 is set to plus. The angle D1 of the guide surface is an angle (plus angle) from the second virtual straight line L2 swung clockwise with respect to the first virtual straight line L1. The angle D1 of the guide surface is preferably equal to or greater than plus 30 degrees and equal to or smaller than 90 degrees. The angle D1 of the guide surface is further preferably plus 45 degrees or smaller than 90 degrees.

Next, the flow of the air around the developing device is described.

Figure 10:
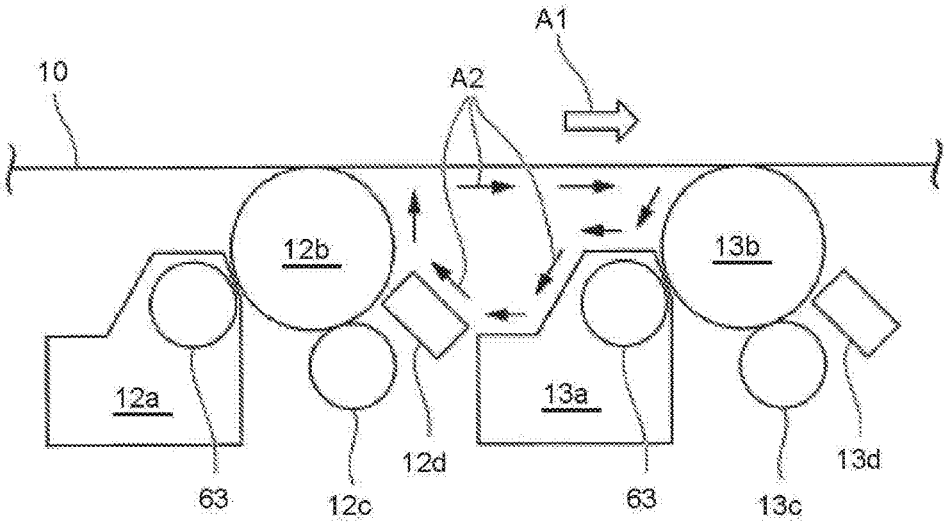
FIG. 10 is a side view for explaining a flow of air around the developing device according to the embodiment.
Figure 11:
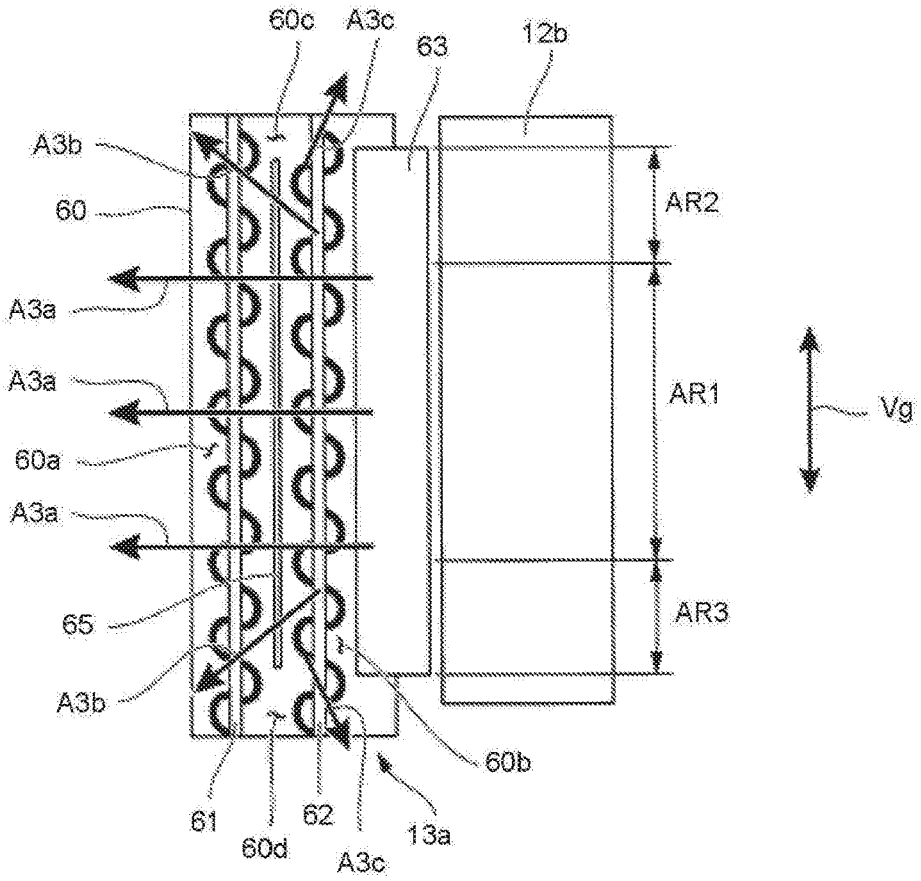
FIG. 11 is a plan view for explaining the flow of the air around the developing device according to the embodiment.

FIG. 10 is a side view for explaining the flow of the air around the developing device according to the embodiment. FIG. 11 is a plan view for explaining the flow of the air around the developing device according to the embodiment. In FIG. 10 and FIG. 11, the flow of the air around the developing device 13*a* positioned at the downstream side in a rotation direction (in the arrow A1 direction) of the intermediate transfer body 10 with respect to the developing device 12*a* is described.

As shown in FIG. 10, the air around the developing device 13*a* flows in an arrow A2 direction between the developing device 13*a* and the intermediate transfer body 10.

As shown in FIG. 11, in a space between the developing device 13*a* and the intermediate transfer body 10 (refer to FIG. 10), an area AR1 in the center of the roller axial direction Vg and areas AR2 and AR3 at ends in the roller axial direction Vg are set. Hereinafter, the area AR1 in the center of the roller axial direction Vg is referred to as a "center area AR1", and the areas AR2 and AR3 at the ends of the roller axial direction Vg are referred to as "end areas AR2 and AR3".

On an outer peripheral surface of the intermediate transfer body 10, at positions extending from the both edges of the intermediate transfer body 10 toward the center of the intermediate transfer body 10 in the roller axial direction Vg by 12% of entire width of the intermediate transfer body 10, air flows in a direction perpendicular to a rotational direction of the intermediate transfer body 10. For example, if the width of the intermediate transfer body 10 is set to 330 mm, the positions extend inwardly from both edges of intermediate transfer body 10 toward the center of the intermediate transfer body 10 by 40 mm. If the width of the developing roller 63 is set to 310 mm in the roller axial direction Vg, the widths of the center area AR1 is about 250 mm, and the widths of the end areas AR2 and AR3 are 30 mm.

In the space between the developing device 13*a* and the intermediate transfer body 10 (refer to FIG. 10), the flow of the air differs between the center area AR1 and the end areas AR2 and AR3. In the center area AR1, the air around the developing device 13*a* flows in an arrow A3*a* direction between the developing device 13*a* and the intermediate transfer body 10. As shown in FIG. 10, in the center area AR1 (refer to FIG. 11), the air around the developing device 13*a* flows in the same direction as the rotation direction (the arrow A1 direction) of the intermediate transfer body 10 in the vicinity of the intermediate transfer body 10. On the other hand, in the center area AR1 (refer to FIG. 11), the air around the developing device 13*a* flows in the direction opposite to the rotation direction (the arrow A1 direction) of the intermediate transfer body 10 in the vicinity of the developing device 13*a*. In other words, in the center area AR1 (refer to FIG. 11), the air around the developing device 13*a* circulates in the arrow A2 direction in the space between the developing device 13*a* and the intermediate transfer body 10. Even if the air containing the toner leaks out of the developing device 13*a* in the center area AR1 (refer to FIG. 11), since the toner is easily conveyed to the intermediate transfer body 10, the possibility of soiling the functional components such as the charging device 12*c* is low.

As shown in FIG. 11, in the end areas AR2 and AR3, there is the flow of the air containing the toner in a direction (direction parallel to the roller axial direction Vg) orthogonal to the rotation direction (the arrow A1 direction) of the intermediate transfer body 10. In the end areas AR2 and AR3, the air around the developing device 13*a* flows in an arrow A3*b* direction or an arrow A3*c* direction in the space between the developing device 13*a* and the intermediate transfer body 10 (refer to FIG. 10). If the air containing the toner leaks out of the developing device 13*a* in the end areas AR2 and AR3, since it is difficult for the toner to be conveyed to the intermediate transfer body 10, there is a high possibility that the functional components such as the charging device 12*c* are contaminated with it.

Next, the flow of the air in the developing device 12*a* is described.

Figure 12:
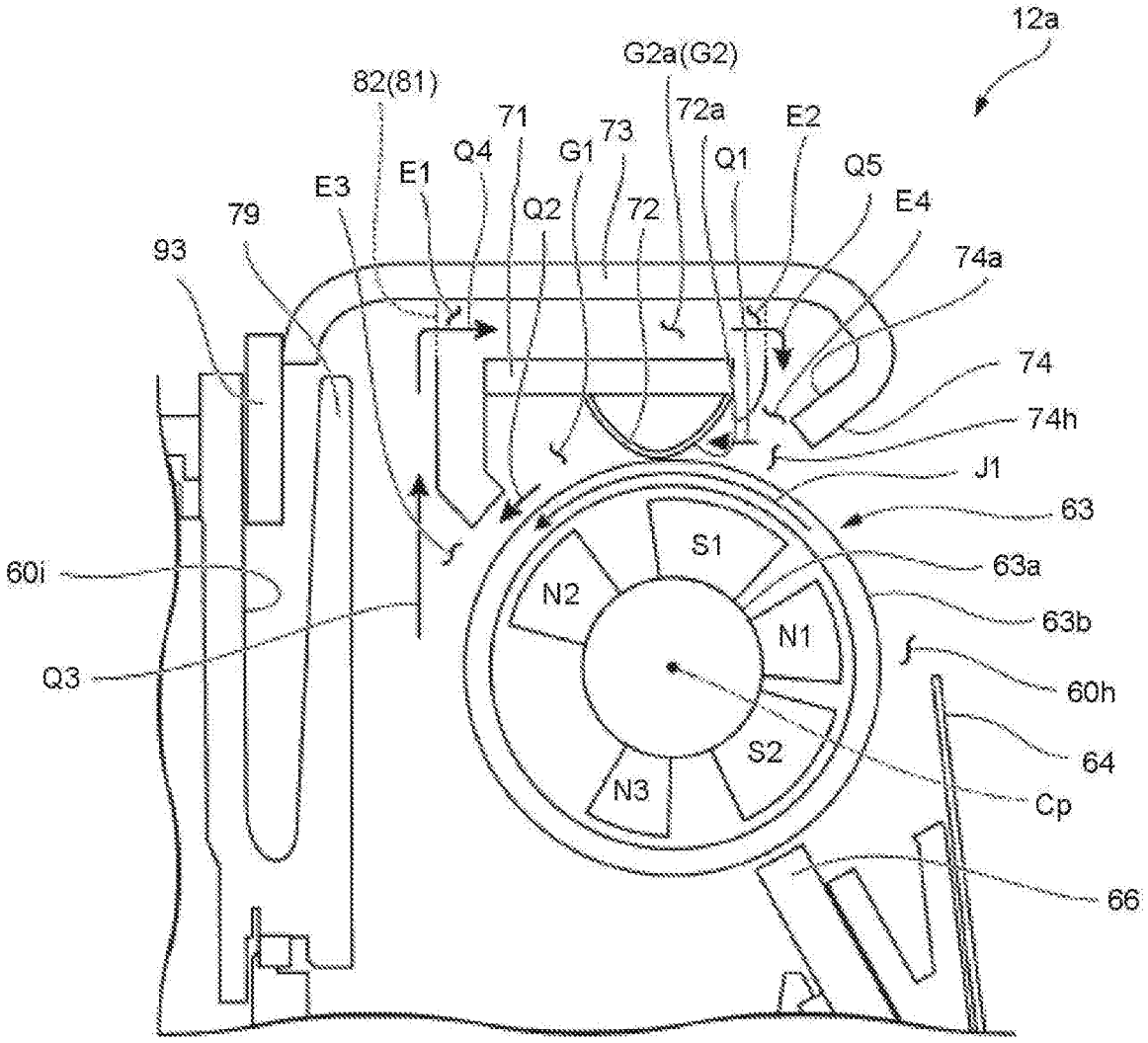
FIG. 12 is a cross-sectional view for explaining the flow of the air in the developing device according to the embodiment.

FIG. 12 is a cross-sectional view for explaining the flow of the air in the developing device 12*a* according to the embodiment. FIG. 12 is a diagram corresponding to FIG. 9.

As shown in FIG. 12, as the developing roller 63 rotates in the arrow J1 direction, the air flows into the housing 60 via the gap 74*h*. If the air flows into the housing 60, an air flow is generated in an arrow Q1 direction or an arrow Q2 direction in the first gap G1. If the air enters the housing 60, the pressure of the inside of the housing 60 increases, so that at the third opening E3, the flow of the air is generated towards an arrow Q3 direction from the inside of the housing 60 to the outside of the housing 60.

The flow of the air in the arrow Q3 direction containing the toner separated from the developer in the housing 60 is guided to the gap 74*h*, and thus, in the second gap G2, a flow of the air towards an arrow Q4 direction and an arrow Q5 direction towards the fourth opening E4 is generated. If the air containing the toner flows in the arrow Q5 direction, it is guided towards the first gap G1 by the guide surface 74*a*, and thus, most of the air containing the toner flows into the first gap G1.

The air containing the toner flowing into the first gap G1 flows in the housing 60 in the order of the arrow Q1 direction, the arrow Q2 direction, the arrow Q3 direction, the arrow Q4 direction, and the arrow Q5 direction. In other words, a circulation path of the flow of the air containing the toner is formed in the housing 60 by the first gap G1, the second gap G2, the first opening E1, the second opening E2, the third opening E3 and the fourth opening E4.

According to the embodiment, the developing device 12*a* has the housing 60, the developing roller 63, the gap forming member 71, and the blocking member 72. The developing roller 63 is rotatably arranged at the inside of the housing 60. The developing roller 63 has the development pole N1. The developing roller 63 executes the development by the developer carried by the magnetic force of the development pole N1. The gap forming member 71 forms the first gap G1 with the developing roller 63. The gap forming member 71 forms the second gap G2 with the housing 60. The gap forming member 71 is arranged in the housing 60.

The gap forming member 71 is arranged at the downstream side of the roller rotation direction J1 with respect to the development pole N1. The blocking member 72 is arranged in the first gap G1. The blocking member 72 is arranged at the downstream side of the roller rotation direction J1 with respect to the development pole N1. The blocking member 72 is arranged at an opposite position facing the first conveyance pole S1 which is the magnetic pole section at the most upstream side in the housing inside the housing 60. With the above constitution, the following effects are achieved. Since it is possible to retain the toner cloud generated at the first conveyance pole S1 in the developing device 12*a*, the scattering of the toner towards the outside of the developing device 12*a* can be suppressed.

Meanwhile, in order to reduce the scattering of the toner to the exterior of the developing device, a filter, a fan, and the like are arranged for recovering the scattered toner. However, there is a possibility that the number of times the filter capturing the toner clogs increases before the end of a product life. The provision of a fan and a duct is necessary for arrangement of the filter, and thus, there is a possibility of increasing the size of the apparatus. According to the embodiment, there is no need to arrange a filter, so that it is preferable for improving maintainability and avoiding enlargement of the apparatus.

Between the housing 60 and the gap forming member 71, the first opening E1 and the second opening E2 are arranged. The first opening E1 is formed at the downstream side of the roller rotation direction J1 with respect to the gap forming member 71. The second opening E2 communicates with the first opening E1 through the second gap G2. The second opening E2 is formed at the upstream side of the roller rotation direction J1 with respect to the gap forming member 71. With the above constitution, the following effects are achieved. The first gap G1, the second gap G2, the first opening E1 and the second opening E2 form the circulation path of the flow of the air containing the toner in the housing 60, and thus, the air containing the toner can be prevented from spouting to the exterior of the developing device 12*a*. Therefore, scattering of the toner towards the exterior of the developing device 12*a* can be suppressed.

By arranging the guide section 74 guiding the air discharged from the second gap G2 via the second opening E2 to the first gap G1, the following effects are achieved. Since the air containing the toner is guided to the first gap G1 by the guide section 74, it is possible to prevent the air containing the toner from spouting to the outside of the developing device 12*a*. Therefore, scattering of the toner to the exterior of the developing device 12*a* can be suppressed.

The guide section 74 extends from the end near the second opening E2 in the housing 60 towards the developing roller 63, and thus, the following effects are achieved. In a case in which the guide section 74 is integrally formed with the casing main body 73 by using the same member, since there is no need to separately arrange the guide member, the number of components can be reduced and the apparatus constitution can be simplified.

In the roller axial direction Vg, the width W1 of the first opening E1 is larger than the width W2 of the second opening E2 (W1>W2), and thus, the following effects are achieved. The flow of the air containing the toner easily concentrates in the center area AR1 compared with a case in which the width W1 of the first opening E1 is equal to or smaller than the width W2 of the second opening E2 (W1≤W2). It is possible to prevent the flow of the air containing the toner from moving towards the end areas AR2 and AR3. Even if the air containing the toner leaks out of the developing device 13*a*, as the toner there is easily conveyed to the intermediate transfer body 10, the possibility of soiling the functional components such as the charging device 12*c* is low. Therefore, it is possible to suppress contamination of functional components such as the charging device 12*c*.

Since the ratio W2/W1 of the width W1 of the first opening E1 to the width W2 of the second opening E2 is equal to or greater than 0.5 and equal to or smaller than 0.8, the following effects are achieved. If W2/W1 is less than 0.5, there is a high possibility that the flow of the air containing the toner is directed to the end areas AR2 and AR3. If W2/W1 is less than 0.5, the width W2 of the second opening E2 is too narrow, and the discharge of the air in the developing device 12*a* is insufficient, which is presumed to result in excessive increase in the pressure in the developing device 12*a*. On the other hand, if W2/W1 exceeds 0.8, the width W2 of the second opening E2 is too wide, making it difficult to concentrate the flow of the air containing the toner in the center area AR1. According to the embodiment, since W2/W1 is equal to or greater than 0.5 and equal to or less than 0.8, the flow of the air containing the toner is concentrated in the center area AR1, it is preferable for suppressing contamination of functional components such as the charging device 12*c*.

The casing main body 73 has the holding section 81 extending towards the gap forming member 71 to hold the gap forming member 71, and thus, the following effects are achieved. It is possible to reduce the number of components and to simplify the apparatus constitution compared with a case in which the holding member is separately arranged for holding the gap forming member 71.

The holding section 81 includes a plurality of ribs 82 arranged at intervals in the roller axial direction Vg and extending linearly in the direction orthogonal to the roller axial direction Vg as seen from the gap forming member 71 side, and thus, the following effects are achieved. Since the plurality of ribs 82 form the plurality of spaces G2*a* communicating the first opening E1 and the second opening E2, it is possible to smoothly pass the air containing the toner through the plurality of spaces G2*a*. If the air containing the toner smoothly flows in the plurality of spaces G2*a*, the air containing the toner can flow smoothly in the circulation path including a plurality of spaces G2*a*. Therefore, it is possible to more effectively suppress the air containing the toner from spouting to the outside of the developing device 12*a*.

The rib 82 is provided with the notch 82*h* opening in the direction parallel to the roller axial direction Vg, and thus, the following effects are achieved. Since the plurality of spaces G2*a* adjacent to each other across the ribs 82 communicates with each other by the notch 82*h*, it is preferable because the air containing the toner can flow more smoothly in the circulation path including the plurality of spaces G2*a*.

The inclined surface 72*a* forms the angle of 45 degrees or less with respect to the tangent of the developing roller 63, and thus, the following effects are achieved. If the inclined surface 72*a* forms an angle greater than 45 degrees with respect to the tangent of the developing roller 63, there is a possibility that the developer on the developing roller 63 collides with the blocking member 72 and a toner cloud occurs. Since the inclined surface 72*a* forms an angle of 45 degrees or less with respect to the tangent of the developing roller 63, it is preferable as the possibility of occurrence of the toner cloud can be reduced.

In the housing 60, the side openings 60*c* and 60*d* for circulating the developer between the first chamber 60*a* and the second chamber 60*b* are formed at both sides of the roller axial direction Vg, and thus, the following effects are achieved. The air at the second chamber 60*b* side easily enters the first chamber 60*a* via the side openings 60*c* and 60*d*. On the other hand, if the pressure in the developing device 12*a* increases, the air containing the toner easily leaks out of both ends in the roller axial direction Vg of the developing device 12*a*. According to the embodiment, the flow of the air including the toner easily concentrates in the center area AR1 compared with a case in which the width W1 of the first opening E1 is equal to or smaller than the width W2 of the second opening E2 (W1≤W2). Therefore, even if the side openings 60*c* and 60*d* are formed at both sides of the roller axial direction Vg in the housing 60, it is possible to suppress contamination of functional components such as the charging device 12*c*.

The blocking member 72 is arranged at the opposite position facing the first conveyance pole S1 which is magnetic pole section at the most upstream side in the housing in the housing 60, and thus, the following effects are achieved. Since the toner cloud generated in the first conveyance pole S1 can be retained in the developing device 12*a*, it is preferable for suppressing the scattering of the toner to the outside of the developing device 12*a*.

Since the angle D1 of the guide surface is plus 30 degrees or more, the following effects are achieved. If the angle D1 of the guide surface is less than plus 30 degrees, the effect of bending the air discharged from the second gap G2 towards the first gap G1 is small. According to the embodiment, since the angle D1 of the guide surface is plus 30 degrees or more, the air discharged from the second gap G2 can be sufficiently bent towards the first gap G1, and thus, it is preferable for suppressing the scattering of the toner to the outside of the developing device 12*a*. Further, since the angle D1 of the guide surface is plus 45 degrees or more, the air discharged from the second gap G2 can be more effectively bent towards the first gap G1, so that it is preferable for suppressing the scattering of the toner to the outside of the developing device 12*a*.

The guiding surface 74*a* is the inner surface of the guide section 74 contacting with the airflow guided by the guide section 74, and thus, the following effects are achieved. Since the air discharged from the second gap G2 can be bent more effectively towards the first gap G1 by the guide surface 74*a*, it is more preferable for suppressing the scattering of the toner to the outside of the developing device 12*a*.

The height Z1 of the first opening E1 and the height Z2 of the second opening E2 are specified by a distance between the casing main body 73 and the gap forming member 71 facing each other, and are 0.5 mm or more, and thus, the following effects are achieved. If the height Z1 of the first opening E1 and the height Z2 of the second opening E2 are less than 0.5 mm, there is a high possibility that the flow of the air in the second gap G2 becomes unsmooth and the efficiency of discharging the air in the developing device 12*a* decreases. According to the embodiment, the height Z1 of the first opening E1 and the height Z2 of the second opening E2 are 0.5 mm or more, so that the flow of the air in the second gap G2 can be smoothed. If the air containing the toner flows smoothly in the second gap G2, the air containing the toner can flow smoothly in the circulation path including the second gap G2. Therefore, it is preferable because it is possible to effectively prevent the air containing the toner from spouting to the outside of the developing device 12*a*. Furthermore, since the height Z1 of the first opening E1 and the height Z2 of the second opening E2 are 1.0 mm or more, the flow of the air in the second gap G2 can be further smoothed, so that it is preferable for effectively preventing the air containing the toner from spouting to the outside of the developing device 12*a*.

A modification is described below.

The holding section 81 is not limited to including a plurality of ribs 82 arranged at intervals in the roller axial direction Vg and extending linearly in the direction orthogonal to the roller axial direction Vg as seen from the gap forming member 71 side. For example, the holding section 81 may have a plurality of ribs 82 extending linearly in a direction intersecting the roller axial direction Vg as seen from the gap forming member 71 side.

Figure 13:
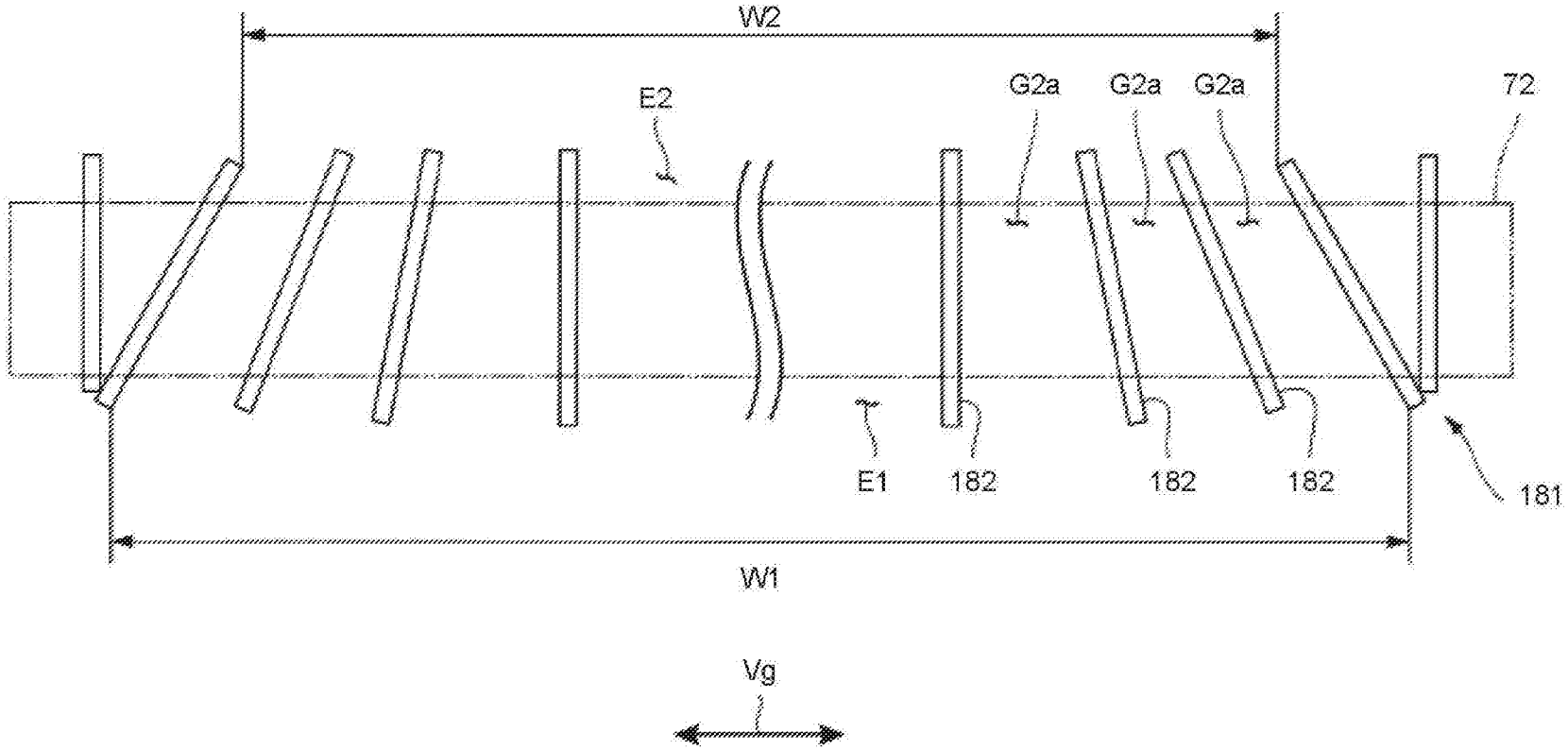
FIG. 13 is a plan view illustrating a modification of the holding section according to the embodiment.

FIG. 13 is a plan view illustrating a modification of the holding section according to the embodiment. FIG. 13 is a diagram corresponding to FIG. 8 obtained by viewing a holding section 181 from the gap forming member 71 (refer to FIG. 7) side. In FIG. 13, the blocking member 72 is indicated by a two-dot chain line.

As shown in FIG. 13, the holding section 181 includes a plurality of ribs 182. As seen from the gap forming member 71 (refer to FIG. 7) side, the plurality of ribs 182 extends linearly in the direction intersecting the roller axial direction Vg so as to be positioned at the center of the roller width direction Vg towards the second opening E2 side. A plurality of ribs 182 forms a plurality of spaces G2*a* communicating the first opening E1 and the second opening E2. The plurality of ribs 182 partitions the second gap G2 (refer to FIG. 4) and forms a plurality of spaces G2*a*. The interval between two adjacent ribs 182 in the roller width direction Vg becomes narrower towards the second opening E2 side.

According to the present modification, a plurality of ribs 182 forms a plurality of spaces G2*a* communicating the first opening E1 and the second opening E2, so that the air containing the toner can flow smoothly in the plurality of spaces G2*a*. If the air containing the toner flows smoothly in the plurality of spaces G2*a*, a circulation path of the flow of the air including the toner is easily formed in the housing 60. Therefore, it is possible to more effectively prevent the air containing the toner from spouting to the outside of the developing device 12*a*.

The guide section 74 is not limited to being integrally formed with the casing main body 73 by using the same member. For example, the guide section 74 may be formed separately from the casing main body 73.

Figure 14:
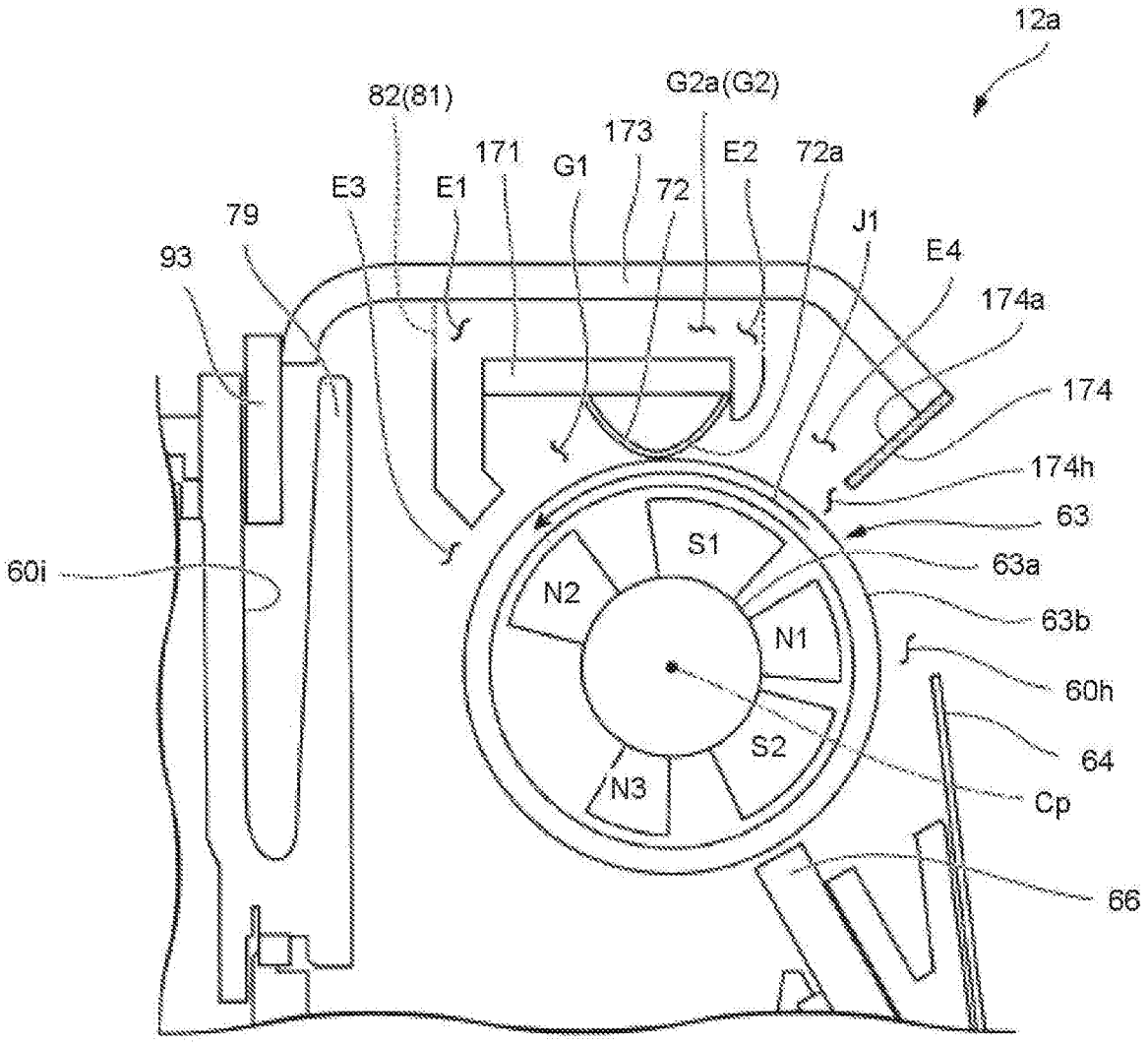
FIG. 14 is a cross-sectional view illustrating a first modification of the guide section according to the embodiment.

FIG. 14 is a cross-sectional view illustrating a first modification of the guide section according to the embodiment. In FIG. 14, cross-section hatching is omitted.

As shown in FIG. 14, a guide section 174 is formed separately from, i.e., formed non-integrally with, a casing main body 173. The guide section 174 is attached to the end, at the opening 60*h* side, of the casing main body 173. The guide section 174 is formed into a plate shape and extends from the end, at the opening 60*h* side, of the casing main body 173 toward the developing roller 63. For example, the guide section 174 is a sheet material such as polyethylene terephthalate (PET).

The guide section 174 guides the direction of the airflow discharged from the second gap G2 through the second opening E2 between the blocking member 72 and the developing roller 63 toward the first gap G1. The guide section 174 has a guide surface 174*a* facing a gap forming member 171 across the fourth opening E4. The guide surface 174*a* is the inner surface of the guide section 174 that makes contact with the airflow guided by the guide section 174. For example, the tip of the guide section 174 is spaced from the developing roller 63. A gap 174*h* is formed between the tip of the guide section 174 and the developing roller 63.

Figure 15:
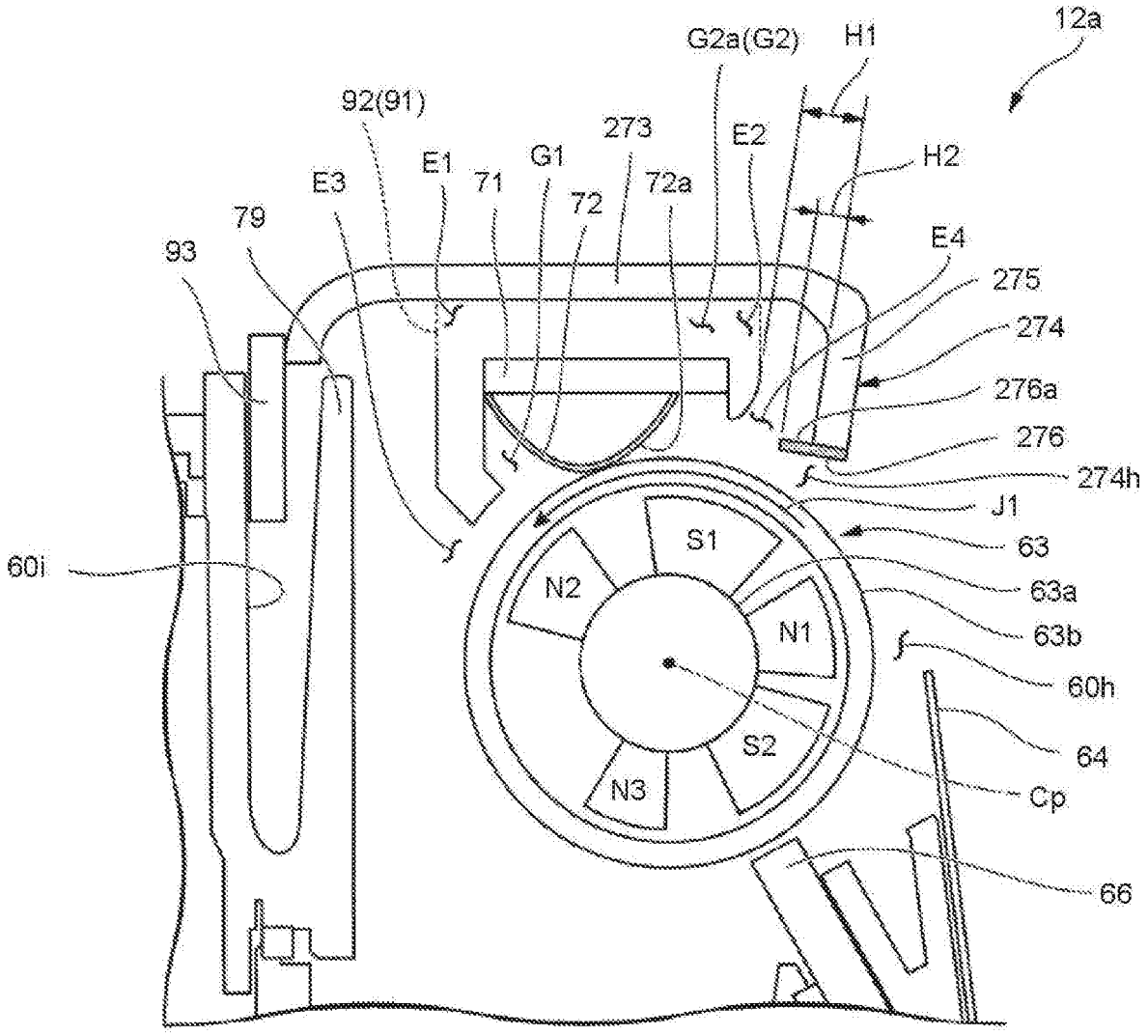
FIG. 15 is a cross-sectional view illustrating a second modification of the guide section according to the embodiment.

FIG. 15 is a cross-sectional view illustrating a second modification of the guide section according to the embodiment. In FIG. 15, cross-section hatching is omitted.

As shown in FIG. 15, a guide section 274 includes an extending portion 275 and a guide plate 276. The extending portion 275 extends from the end of the guide section 274, near the second opening E2 in the housing, toward the developing roller 63. The extending portion 275 extends from the end of the guide section 274, at the opening 60*h* side of a casing main body 273, toward the developing roller 63. Here, the extending portion 275 is integrally formed with the casing main body 273 as part of the same member. The tip of the extending portion 275 is spaced from the developing roller 63.

The guide plate 276 is formed separately from, i.e., formed non integrally with, the casing main body 273. The guide plate 276 is attached to the tip of the extending portion 275. The guide plate 276 is formed into a plate shape extending from the tip of the extending portion 275 towards the first gap G1. For example, the guide plate 276 is a sheet material such as polyethylene terephthalate (PET).

The guide plate 276 guides the air discharged from the second gap G2 through the second opening E2 toward the first gap G1. The guide plate 276 has a guide surface 276*a* facing the fourth opening E4. The guide surface 276*a* is an inner surface of the guide plate 276 which makes contact with the airflow guided by the guide plate 276. The guide plate 276 is spaced from the developing roller 63. A gap 274*h* is formed between the guide plate 276 and the developing roller 63.

The blocking member 72 of the present modification is arranged in the vicinity of the opposite position facing the first conveyance pole S1 which is the magnetic pole section at the most upstream side in the housing at the inside of the housing 60. Additionally, the blocking member 72 of the present modification is arranged such that the furthest extension thereof from the gap forming member is located between the first conveyance pole S1 and the peeling pole N2 adjacent to the outer surface of the developing roller 63. The blocking member 72 is arranged between the first conveyance pole S1 and the peeling pole N2 in the roller rotation direction J1.

A height H1 of the second opening E2 is larger than a projecting height H2 of the guide plate 276 (H1>H2) from the guide surface 74*a* (FIG. 4). For example, the height H1 of the second opening E2 is 2.5 mm, and the protruding height H2 of the guide plate 276 is 1.0 mm. A difference (H1−H2) between the height H1 of the second opening E2 and the projecting height H2 of the guide plate 276 is preferably equal to or greater than 0.5 mm and equal to or smaller than 2.0 mm. The difference (H1−H2) is more preferably equal to or greater than 1.0 mm and equal to or smaller than 1.5 mm.

According to the present modification, the guide section 274 includes the extending portion 275 and the guide plate 276. The extending portion 275 extends from the end near the second opening E2 in the housing towards the developing roller 63. The guide plate 276 extends from the tip of the extending portion 275 towards the first gap G1. With the above constitution, the following effects are achieved. If the extending portion 275 is integrally formed with the casing main body 273 as an integral part of the same member, since it is unnecessary to separately arrange an extending member, the number of components can be reduced and the apparatus constitution can be simplified. In addition, if the guide plate 276 is formed separately from the casing main body 273, the orientation of the guide plate 276 is easily optimized.

The difference (H1−H2) of the height H1 of the second opening E2 and the projecting height H2 of the guide plate 276 is equal to or greater than 0.5 mm and equal to or smaller than 2.0 mm, and thus, the following effects are achieved. If the difference (H1−H2) is less than 0.5 mm, there is a high possibility that the flow of the air in the second opening E2 becomes unsmooth and the efficiency of discharging the air from the developing device 12*a* decreases. On the other hand, if the difference (H1−H2) exceeds 2.0 mm, the effect of bending the air discharged from the second gap G2 towards the first gap G1 is reduced. According to the embodiment, the difference (H1−H2) is equal to or greater than 0.5 mm and equal to or smaller than 2.0 mm, and thus, it is possible to smooth the flow of the air in the second opening E2 and to sufficiently bend the air discharged from the second gap G2 towards the gap G1. Therefore, it is preferable for suppressing the scattering of the toner to the outside of the developing device 12*a*.

The blocking member 72 is arranged between the first conveyance pole S1 and the peeling pole N2 in the roller rotation direction J1, and thus, the following effects are achieved. It is preferable for arranging the second opening E2 and the blocking member 72 at an appropriate distance in the developing device 12*a*. For example, it is easy to optimize the orientation of the guide plate 276. In particular, if the developing roller 63 having a small diameter of 18 mm or less is used, it is preferable because it is easy to ensure the arrangement space of the blocking member 72 and the guide plate 276.

The first opening E1 and the second opening E2 are not limited to be continuous in the roller axial direction Vg. For example, at least one of the first opening E1 and the second opening E2 may be divided in the roller axial direction Vg. The height Z1 of the first opening E1 and the height Z2 of the second opening E2 are 0.5 mm or more even if at least one of the first opening E1 and the second opening E2 is divided in the roller axial direction Vg.

Figure 16:
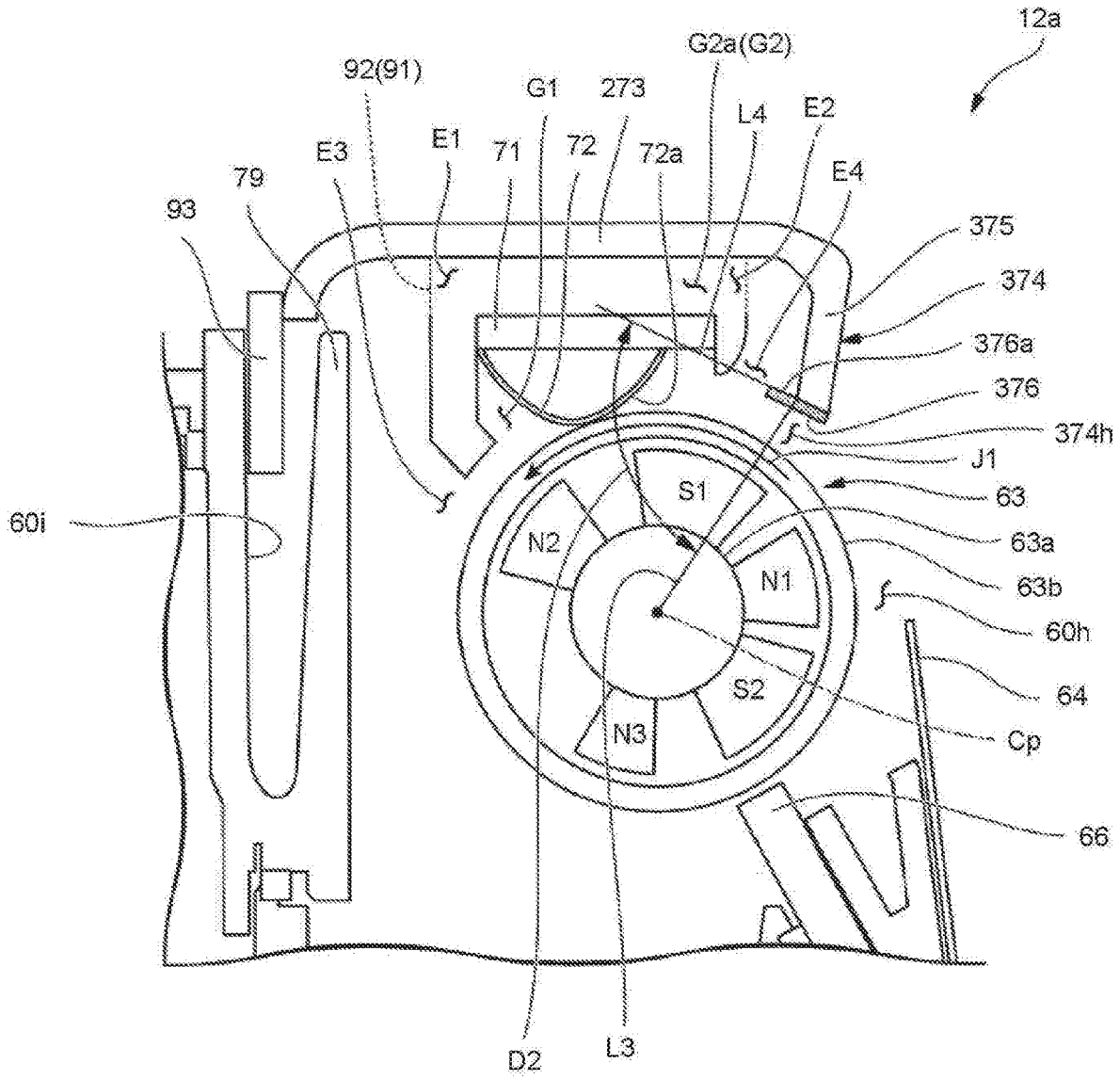
FIG. 16 is a cross-sectional view illustrating a third modification of the guide section according to the embodiment.

FIG. 16 is a cross-sectional view illustrating a third modification of the guide section according to the embodiment. In FIG. 16, cross-section hatching is omitted. In the third modification, the description of the same constitution as the second modification is omitted.

As shown in FIG. 16, a third virtual straight line L3 passing through the rotation center Cp of the developing roller 63 and the tip of an extending portion 375 of a guide section 374, and a fourth virtual straight line L4 passing along the guide surface 376*a* of a guide plate 376 are set. Hereinafter, an angle D2 formed by the third virtual straight line L3 and the fourth virtual straight line L4 if viewed from the roller axial direction Vg (refer to FIG. 5) is also referred to as an "angle D2 of the guide surface".

A direction in which the fourth virtual straight line L4 swings clockwise with respect to the third virtual straight line L3 is set to plus. The angle D2 of the guide surface is an angle (plus angle) where the fourth virtual straight line swings clockwise with respect to the third virtual straight line L3. The angle D2 of the guide surface is preferably plus 30 degrees or more. The angle D2 of the guide surface is more preferably plus 45 degrees or more. In the present modification, the angle D2 of the guide surface is a 90 degrees.

According to the present modification, since the angle D2 of the guide surface is plus 90 degrees, the air discharged from the second gap G2 can be sufficiently bent towards the first gap G1, which is effective for suppressing the scattering of the toner to the exterior of the developing device 12*a*.

Figure 17:
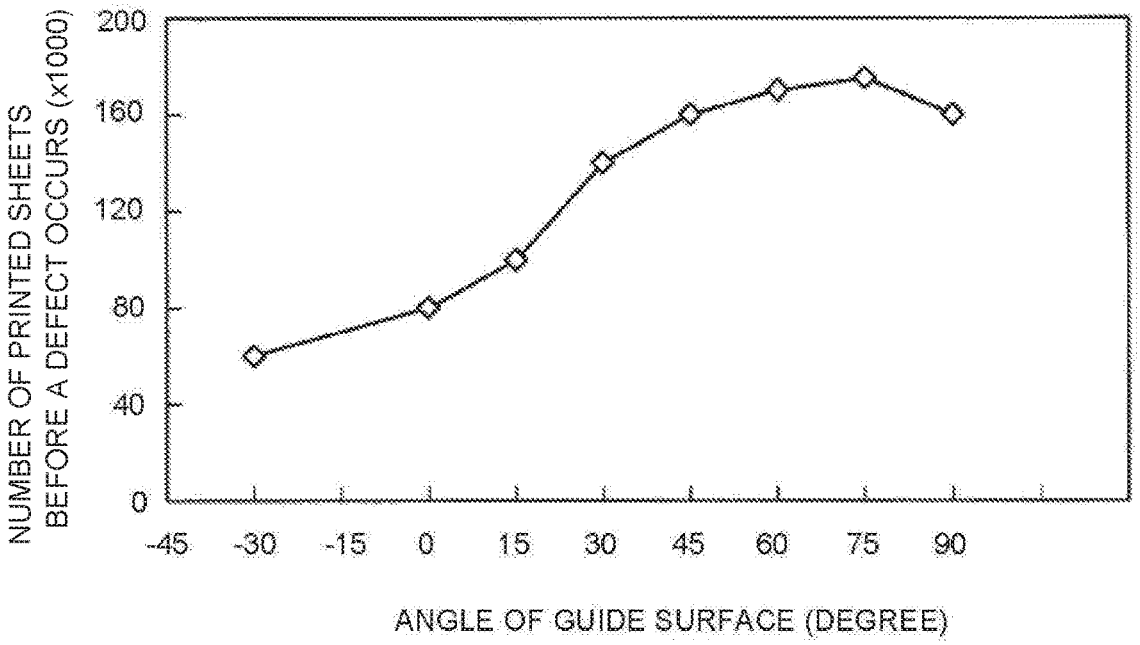
FIG. 17 is a diagram illustrating the relationship between an angle of a guide surface and the number of defective printed sheets.

FIG. 17 is a diagram illustrating the relationship between the angle of the guide surface and the number of printed sheets before a defect occurs. In FIG. 17, a horizontal axis represents the angle (degree) of the guide surface and a vertical axis represents the number of defective printed sheets (*1000). The number of printed sheets before a defect occurs is the number of sheets until contamination of the charging device due to the toner contamination and contamination of an image occurs at the time of executing a sheet passing test at a high temperature and a high humidity (temperature 30 degrees centigrade, humidity 85%) which are not conducive to the scattering of the toner.

As shown in FIG. 17, if the angle of the guide surface is equal to or greater than plus 30 degrees and equal to or smaller than 90 degrees, it is confirmed that the number of printed sheets until a defect occurs is 140,000 or more. In particular, it is confirmed that the number of printed sheets before a defect occurs is 160,000 or more if the angle of the guide surface is equal to or greater than plus 45 degrees and equal to or smaller than 90 degrees.

Figure 18:
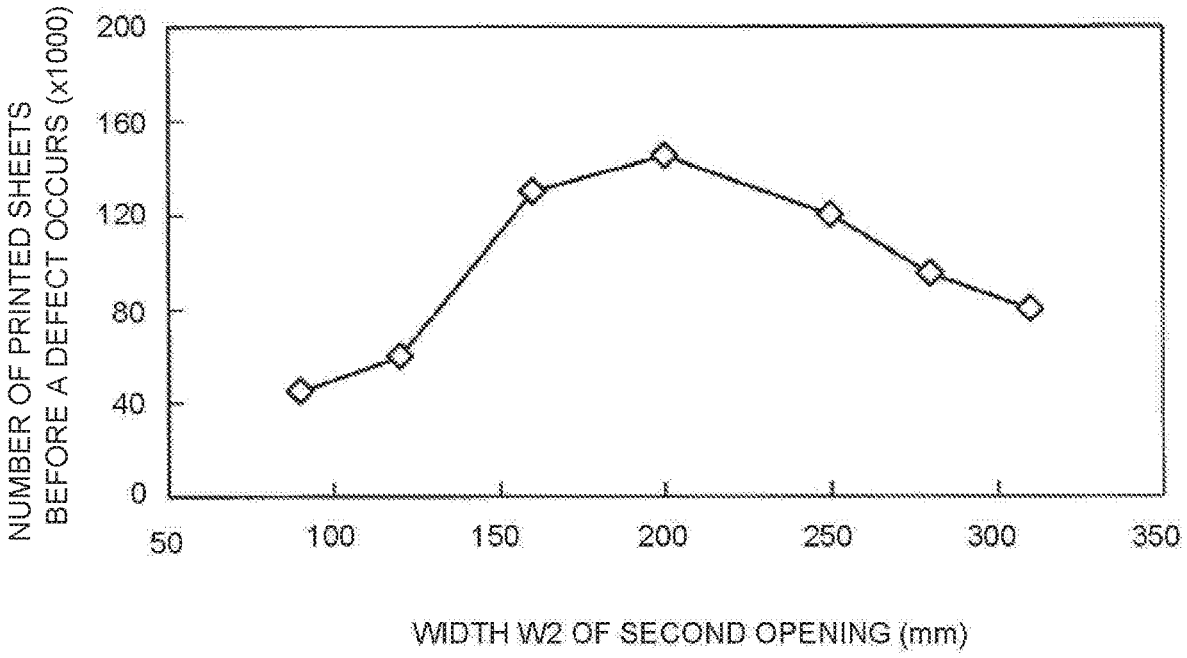
FIG. 18 is a diagram illustrating the relationship between a width of a second opening and the number of defective printed sheets.

FIG. 18 is a diagram illustrating the relationship between the width of the second opening and the number of printed sheets before a defect occurs. In FIG. 18, a horizontal axis represents the width W2 (mm) of the second opening, and a vertical axis represents the number of defective printed sheets (*1000).

As shown in FIG. 18, it is confirmed that the number of printed sheets before a defect occurs is 120,000 or more if the width W2 of the second opening is equal to or greater than 160 mm and equal to or smaller than 250 mm.

The inventor of the present invention confirms the relationship between the ratio W2/W1 of the width W1 of the first opening to the width W2 of the second opening and the number of defective printed sheets.

TABLE 1

| WIDTH W2 OF SECOND OPENING (mm) | W2/W1 | NUMBER OF PRINTED SHEETS BEFORE DEFECT OCCURS (*1000) |
|---|---|---|
| 90 | 0.29 | 45 |
| 120 | 0.39 | 60 |
| 160 | 0.52 | 130 |
| 200 | 0.65 | 145 |
| 250 | 0.81 | 120 |
| 280 | 0.90 | 95 |
| 310 | 1.00 | 80 |

Table 1 shows the relationship between the ratio W2/W1 of the width W1 of the first opening to the width W2 of the second opening and the number of printed sheets before a defect occurs. As shown in Table 1, if the ratio W2/W1 is equal to or greater than 0.52 and equal to or smaller than 0.81, it is confirmed that the number of defective printed sheets is 120,000 or more.

According to the developing device of at least one embodiment described above, the scattering of the toner to the exterior of the developing device can be suppressed.

The functions of the image forming apparatus according to the foregoing embodiment may be realized by a computer. In this case, the functions may be realized by recording programs for realizing the functions in a computer-readable recording medium and reading the programs recorded in the recording medium into a computer system to execute it. Further, it is assumed that the "computer system" described herein contains an OS or hardware such as peripheral devices. Further, the "computer-readable recording medium" refers to a portable medium such as a flexible disk, a magneto-optical disk, a ROM, a CD-ROM and the like or a storage device such as a hard disk built in the computer system. Furthermore, the "computer-readable recording medium" refers to a medium for dynamically holding the programs for a short time like a communication wire in a case in which the programs are sent via a communication line such as a network like the Internet or a telephone line or a medium for holding the programs for a certain time like a volatile memory in the computer system serving as a server and a client. The foregoing programs may realize a part of the above-mentioned functions or realize the functions described above by the combination with the programs already recorded in the computer system.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A developing device, comprising:

a housing having an opening in a wall thereof;

a developing roller, having a hollow interior portion and an axis of rotation, rotatably arranged within the housing to rotate in a rotation direction about the axis of rotation;

a magnetic pole structure disposed within the hollow interior portion of the roller, at least a portion thereof facing the opening in the wall of the housing, wherein the developing roller is configured to carry a developer on an outer surface thereof using a magnetic force of the magnetic pole structure;

a gap forming member located within, and spaced from, the housing at a location downstream, in the rotation direction of the developing roller, of the opening in the wall of the housing, forming a first gap with respect to the developing roller and forming a second gap with respect to the housing, the gap forming member having a first side facing the opening in the wall of the housing and a second side spaced inwardly of the housing, from the first wall; and a blocking member located in the first gap and at one of the first and second sides of the gap forming member.

2. The developing device of claim 1, further comprising:

a first opening and a second opening spaced from the first opening across the second gap between the gap forming member and the housing, wherein the first opening is located farther from the opening in the wall of the housing than the second opening.

3. The developing device of claim 2, further comprising:

a guide section configured to guide airflow discharged from the second opening to flow between the blocking member and the developing roller.

4. The developing device of claim 3, wherein the guide section extends from a portion of the housing adjacent to the opening in the wall thereof toward the developing roller.

5. The developing device of claim 3, wherein the guide section includes a first portion forming one side of the opening in the housing, and a guide plate extending from the first portion toward the developing roller.

6. The developing device of claim 1, wherein the blocking member is supported on the gap forming member.

7. The developing device of claim 6, wherein the blocking member has a convex shape extending from the gap forming member.

8. The developing device of claim 6, wherein the blocking member is flexible, and extends sufficiently from the gap forming member to contact the developing roller.

9. The developing device of claim 8, wherein the outer surface of the developing roller and the blocking member together form an air valve.

10. A developing device, comprising:

a housing having an enclosure wall and an opening in the enclosure wall thereof;

a developing roller, having a hollow interior portion and an axis of rotation, located within the housing adjacent to the opening in the enclosure wall, such that a portion of the circumference thereof is directly exposed to the opening in the enclosure wall surface of the housing, the developing roller configured to rotate in a rotation direction about the axis of rotation thereof;

a magnetic pole structure disposed within the hollow interior portion of the roller, comprising:

at least a portion of a first pole thereof of a first polarity facing the opening in the wall of the housing;

a second pole thereof of the first polarity disposed within the developer roller at a location inwardly of the housing relative to, and spaced from, the first pole; and a third pole, of a second polarity, disposed between the first and second poles, whereby the developing roller is configured to carry a developer on an outer surface thereof using a magnetic field of the magnetic pole structure to selectively attract the developer to the outer surface thereof;

a gap forming member located within, and spaced from, the housing at a location downstream, in the rotation direction of the developing roller, of the opening in the wall of the housing, forming a first gap with respect to the developing roller and forming a second gap with respect to the housing; and a blocking member located in the first gap, the blocking member located at one of a first location facing the third pole, or a second location facing the second pole.

11. The developing device of claim 10, further comprising:

a first opening and a second opening spaced from the first opening across the second gap between the gap forming member and the housing, wherein the first opening is located further from the opening in the wall of the housing than the second opening.

12. The developing device of claim 11, further comprising:

a guide section configured to guide airflow discharged from the second opening to flow between the blocking member and the developing roller.

13. The developing device of claim 12, wherein the guide section extends from a portion of the housing adjacent to the opening in the wall thereof toward the developing roller.

14. The developing device of claim 12, wherein the guide section includes a first portion forming one side of the opening in the housing, and a guide plate extending from the first portion toward the developing roller.

15. The developing device of claim 10, wherein the blocking member is supported on the gap forming member.

16. The developing device of claim 15, wherein the blocking member has a convex shape extending from the gap forming member.

17. The developing device of claim 15, wherein the blocking member is flexible, and extends sufficiently from the gap forming member to contact the developing roller.

18. The developing device of claim 17, wherein the outer surface of the developing roller and the blocking member together form an air valve.

19. The developing device of claim 10, wherein the housing further comprises a shielding section extending therefrom partially over the opening in the wall of the housing.

20. The developing device of claim 11, wherein the gap forming member extends from the second opening toward the developing roller to form a third opening of the gap forming member therebetween.

* * * * *